US010758831B2

(12) United States Patent
Briggs et al.

(10) Patent No.: US 10,758,831 B2
(45) Date of Patent: Sep. 1, 2020

(54) INTERACTIVE PLAY CENTER WITH INTERACTIVE ELEMENTS AND CONSEQUENCE ELEMENTS

(71) Applicant: Whitewater West Industries Ltd., Richmond (CA)

(72) Inventors: Rick A. Briggs, Springfield, IL (US); Mark Vidal, Richmond (CA); Mark Hewett, Surrey (CA)

(73) Assignee: Whitewater West Industries LTD., British Columbia (CA)

( * ) Notice: Subject to any disclaimer, the term of this patent is extended or adjusted under 35 U.S.C. 154(b) by 0 days.

(21) Appl. No.: 14/943,814

(22) Filed: Nov. 17, 2015

(65) Prior Publication Data

US 2016/0184718 A1 Jun. 30, 2016

Related U.S. Application Data

(60) Provisional application No. 62/080,895, filed on Nov. 17, 2014.

(51) Int. Cl.
*A63G 31/00* (2006.01)
*A63G 33/00* (2006.01)

(52) U.S. Cl.
CPC ..... *A63G 31/007* (2013.01); *A63G 31/00* (2013.01); *A63G 33/00* (2013.01)

(58) Field of Classification Search
CPC ..... A63B 9/00; A63G 31/00; A63G 31/007; A63H 23/16
USPC ..... 472/117, 128, 129; 446/153, 156
See application file for complete search history.

(56) References Cited

U.S. PATENT DOCUMENTS

| | | | |
|---|---|---|---|
| 973,105 | A | 10/1910 | Chamberlain, Jr. |
| 1,529,467 | A | 3/1925 | Davis |
| 1,648,196 | A | 11/1927 | Rohmer |
| 1,789,680 | A | 1/1931 | Gwinnett |
| 1,935,543 | A | 11/1933 | Coughlin |
| 2,001,366 | A | 5/1935 | Mittelman |
| 2,752,725 | A | 7/1956 | Unsworth |
| 2,902,023 | A | 9/1959 | Waller |

(Continued)

FOREIGN PATENT DOCUMENTS

| | | |
|---|---|---|
| DE | 1 031 693 | 6/1958 |
| DE | 32 42 358 A1 | 5/1983 |

(Continued)

*Primary Examiner* — Kien T Nguyen
(74) *Attorney, Agent, or Firm* — Buchalter, a professional corp.; J. Rick Taché; Kari L. Barnes

(57) ABSTRACT

An entertainment venue, amusement attraction, or interactive play center configured to provide a variety of activities for users. The play center may include at least one interactive element (such as a button, handle, pull-rope, switch, etc.) that is configured to be interacted with by a user. The play center may also include at least one consequence element (such as a water nozzle, tipping bucket, etc.) that is configured to provide a consequence (such as a spray of water) based upon interaction by a user with the at least one interactive element. In certain embodiments, it may not be apparent, for example via visual, audible, or other indications to a user which consequence element, or how a given consequence element will respond, in response to an interactive element, lending to a sense of surprise and/or need for experimentation on the play center.

20 Claims, 25 Drawing Sheets

(56) References Cited

U.S. PATENT DOCUMENTS 2,977,118 A 3/1961 Farkas
3,120,955 A 2/1964 Carlin
3,135,512 A 6/1964 Taylor
3,141,670 A 7/1964 Smymi
3,170,171 A 2/1965 Mayhew
3,231,269 A 1/1966 Dalrymple
3,246,892 A 4/1966 Grudoski
3,336,030 A 8/1967 Martell et al.
3,355,580 A 11/1967 Wachs
3,395,920 A 8/1968 Moe
3,400,703 A 9/1968 Rhodes
3,468,533 A 9/1969 House, Jr.
3,539,181 A 11/1970 Larsen
3,570,848 A 3/1971 Bowen
3,572,472 A 3/1971 Snead
3,572,712 A 3/1971 Vick
3,601,397 A 8/1971 Carlin
3,605,715 A 9/1971 Welbourn
D222,487 S 10/1971 Korte
3,633,560 A 1/1972 De Freitas
3,633,904 A 1/1972 Kojima
3,662,729 A 5/1972 Henderson
3,668,715 A 6/1972 Chase
D225,344 S 12/1972 Henning
3,743,281 A 7/1973 Gimbel
3,752,472 A 8/1973 Snead
3,802,705 A 4/1974 Burns
3,843,127 A 10/1974 Lack
3,851,880 A 12/1974 Ritch
3,866,916 A 2/1975 Clarke
3,905,349 A 9/1975 Nielson
3,938,272 A 2/1976 Ditto
3,949,679 A 4/1976 Barber
D241,664 S 9/1976 Ewers
3,989,027 A 11/1976 Kahelin
4,014,540 A 3/1977 Caulkins
4,037,355 A 7/1977 Street
D245,435 S 8/1977 Gnehm
4,046,131 A 9/1977 Clark
4,055,341 A 10/1977 Martinez
D246,477 S 11/1977 Callecod
4,057,244 A 11/1977 Gaspar
4,111,179 A 9/1978 Hashimoto
D250,782 S 1/1979 Gibson
D250,783 S 1/1979 Dieter
D250,784 S 1/1979 Dieter
D251,262 S 3/1979 Barrett
4,145,042 A 3/1979 Becker
4,149,710 A 4/1979 Rouchard
4,153,250 A 5/1979 Anthony
4,159,113 A 6/1979 Callecod
4,165,073 A 8/1979 Kellerstrass
4,165,729 A 8/1979 Niemirow
D253,363 S 11/1979 Dieter
4,175,665 A 11/1979 Dogliotti
4,186,927 A 2/1980 Breslow
4,194,733 A 3/1980 Whitehouse, Jr.
4,196,900 A 4/1980 Becker
4,198,043 A 4/1980 Timbes
4,205,785 A * 6/1980 Stanley ..... A63H 23/16
239/17
4,215,867 A 8/1980 Natwick
4,219,198 A 8/1980 Meyer
4,243,220 A 1/1981 Shelley
4,251,069 A 2/1981 Beller
4,261,319 A 4/1981 Dixon
4,262,900 A 4/1981 Vinson
4,296,929 A 10/1981 Meyer et al.
4,303,247 A 12/1981 Fain
4,343,464 A 8/1982 Dose
4,418,792 A 12/1983 Cerone
4,487,411 A 12/1984 Ahrens
D277,610 S 2/1985 Arginsky
D277,640 S 2/1985 Drexler
4,505,897 A 3/1985 Coy
4,548,357 A 10/1985 Schmidt
4,573,679 A 3/1986 Janszen
4,595,369 A 6/1986 Downs
4,627,620 A 12/1986 Yang
4,630,709 A 12/1986 Taylor
4,645,458 A 2/1987 Williams
4,750,733 A 6/1988 Foth
4,778,430 A 10/1988 Goldfarb
4,786,088 A 11/1988 Ziu
4,799,665 A 1/1989 Bracy
4,805,896 A 2/1989 Moody
4,805,897 A 2/1989 Dubeta
4,805,898 A 2/1989 Jacober
D302,198 S 7/1989 Mercer
4,858,390 A 8/1989 Kenig
4,865,312 A 9/1989 Katz
4,898,198 A 2/1990 Castlebury
4,932,917 A 6/1990 Klitsner
4,951,644 A 8/1990 Bon
4,960,275 A 10/1990 Magon
4,961,535 A 10/1990 Skibik
4,973,042 A 11/1990 Skibik
4,995,371 A 2/1991 Kuizinas
5,000,155 A 3/1991 Gallagher
5,011,134 A 4/1991 Langford
5,011,161 A 4/1991 Galphin
5,113,842 A 5/1992 Moorman
5,114,344 A 5/1992 Fumagalli
5,115,794 A 5/1992 Moorman
5,127,657 A 7/1992 Ikezawa
5,133,330 A 7/1992 Sharp
5,135,440 A 8/1992 Smollar
5,151,069 A 9/1992 Skalka
D330,579 S 10/1992 Briggs
5,156,339 A 10/1992 Gibson
5,176,060 A 1/1993 Thornton
5,194,006 A 3/1993 Zaenglein, Jr.
5,194,048 A 3/1993 Briggs
5,213,547 A 5/1993 Lochtefeld
5,224,701 A 7/1993 Sciarrillo
5,226,864 A 7/1993 Showers
D340,273 S 10/1993 Ezell
5,251,906 A 10/1993 Heller
5,256,120 A 10/1993 Howell
5,288,071 A 2/1994 Solomon
5,320,362 A 6/1994 Bear et al.
5,330,400 A 7/1994 Huberman
5,343,849 A 9/1994 Steer
D352,327 S 11/1994 Delaney
5,378,197 A 1/1995 Briggs
5,382,026 A 1/1995 Harvard
5,385,472 A 1/1995 Mullin
5,387,158 A 2/1995 Bertrand
5,387,159 A 2/1995 Hilgert
5,393,074 A 2/1995 Bear
5,401,214 A 3/1995 Smollar
D357,299 S 4/1995 Laing
5,403,238 A 4/1995 Baxter et al.
5,405,294 A 4/1995 Briggs
D358,190 S 5/1995 Strawcutter
5,411,269 A 5/1995 Thomas
5,417,435 A 5/1995 Peretz
5,421,575 A 6/1995 Triner
5,431,410 A 7/1995 Hampton
5,435,570 A 7/1995 Labrasseur
D361,116 S 8/1995 Shaneour
5,437,573 A 8/1995 Rodriguezferre
5,439,199 A 8/1995 Briggs
5,442,261 A 8/1995 Lee
5,443,261 A 8/1995 Lee et al.
5,447,144 A 9/1995 Ivy
5,450,838 A 9/1995 Nakahigashi
5,452,893 A 9/1995 Faulk
5,453,053 A 9/1995 Danta et al.
D366,086 S 1/1996 Ziegler, Jr.
5,480,336 A 1/1996 Blanchard
5,482,510 A 1/1996 Ishii
5,499,821 A 3/1996 Rycroft
5,505,663 A 4/1996 Goulart

(56) References Cited

U.S. PATENT DOCUMENTS 5,507,271 A 4/1996 Actor
5,507,696 A 4/1996 Smollar
5,509,806 A 4/1996 Ellsworth
5,515,837 A 5/1996 Nin
5,533,933 A 7/1996 Gamjost et al.
5,536,210 A 7/1996 Barber
5,554,074 A 9/1996 Von Parrish
D371,414 S 10/1996 King
D374,901 S 10/1996 Cacciola
5,577,945 A 11/1996 LaBelle
5,580,316 A 12/1996 Hill
5,580,319 A 12/1996 Hamilton
5,611,321 A 3/1997 Bigari
5,632,878 A 5/1997 Kitano
5,649,867 A 7/1997 Briggs
D382,618 S 8/1997 Gift
5,662,525 A 9/1997 Briggs
5,667,217 A 9/1997 Kelly
5,669,822 A 9/1997 Smollar
5,673,918 A 10/1997 Bigari
5,676,602 A 10/1997 Katz
D385,941 S 11/1997 Carpenter
5,683,314 A 11/1997 Musso
5,685,778 A 11/1997 Sheldon
5,702,232 A 12/1997 Moore
D389,892 S 1/1998 Van Wegenen
5,709,581 A 1/1998 Rothbarth
D393,687 S 4/1998 Griger
5,735,748 A 4/1998 Meyers
5,741,189 A 4/1998 Briggs
5,775,998 A 7/1998 Ikematsu et al.
5,779,240 A 7/1998 Santella
5,785,592 A 7/1998 Jacobsen
D397,188 S 8/1998 Bro
5,816,980 A 10/1998 Myszka
5,820,471 A * 10/1998 Briggs ..... A63B 9/00 472/117
5,820,472 A 10/1998 Briggs
5,836,817 A 11/1998 Acres
5,839,964 A 11/1998 Rudell
D403,392 S 12/1998 Briggs
5,853,332 A * 12/1998 Briggs ..... A63B 9/00 472/128
5,855,372 A 1/1999 Thiemann
5,855,483 A 1/1999 Collins
5,865,679 A 2/1999 Seabolt
5,865,680 A 2/1999 Briggs
D406,871 S 3/1999 Briggs
D407,133 S 3/1999 Briggs
5,884,563 A 3/1999 Sheldon
5,924,695 A 7/1999 Heykoop
5,942,969 A 8/1999 Wicks
D413,957 S 9/1999 Briggs
5,957,779 A 9/1999 Larson
5,967,901 A 10/1999 Briggs
5,967,916 A 10/1999 Robeson
D416,066 S 11/1999 Briggs
5,984,788 A 11/1999 Lebensfeld et al.
D421,283 S 2/2000 Briggs
6,089,987 A 7/2000 Briggs
6,095,926 A 8/2000 Hettema et al.
6,112,318 A 8/2000 Briggs
6,129,549 A 10/2000 Thompson
6,132,318 A * 10/2000 Briggs ..... A63B 9/00 472/128
6,174,242 B1 1/2001 Briggs
6,186,902 B1 2/2001 Briggs
6,210,287 B1 * 4/2001 Briggs ..... A63G 31/00 273/394
6,220,965 B1 4/2001 Hanna
6,214,803 B1 5/2001 Watkins
6,231,451 B1 5/2001 Briggs
6,234,803 B1 5/2001 Watkins
6,254,101 B1 7/2001 Young
6,264,202 B1 7/2001 Briggs
6,273,425 B1 8/2001 Wesffall
6,276,353 B1 8/2001 Briggs
6,283,871 B1 9/2001 Briggs
6,319,139 B1 11/2001 Tracy
6,352,478 B1 3/2002 Gabai
6,371,853 B1 4/2002 Borla
6,375,578 B1 * 4/2002 Briggs ..... A63G 31/007 472/117
6,386,538 B1 5/2002 Mejia
6,409,379 B1 6/2002 Gabathuler et al.
6,438,193 B1 8/2002 Ko et al.
6,443,849 B1 9/2002 Byrd
6,527,646 B1 3/2003 Briggs
6,561,049 B2 5/2003 Akiymna et al.
6,569,023 B1 5/2003 Briggs
6,595,863 B2 7/2003 Briggs
6,607,123 B1 8/2003 Chmnberlain et al.
6,608,563 B2 8/2003 Jollifee et al.
6,634,949 B1 10/2003 Briggs
6,651,268 B1 11/2003 Briggs
6,682,074 B2 1/2004 Weston
6,725,107 B2 4/2004 MacPherson
6,739,979 B2 5/2004 Tracy
6,746,334 B1 6/2004 Barney
6,761,637 B2 7/2004 Weston
6,786,830 B2 9/2004 Briggs
6,796,908 B2 9/2004 Weston
6,967,563 B2 11/2005 Bormaster
6,967,566 B2 11/2005 Weston
7,004,847 B2 2/2006 Henry
7,029,400 B2 4/2006 Briggs
7,040,998 B2 5/2006 Jolliffe et al.
7,052,391 B1 5/2006 Luciano, Jr.
7,056,221 B2 6/2006 Thirkettle et al.
7,059,974 B1 6/2006 Golliffe et al.
7,066,781 B2 6/2006 Weston
7,160,196 B2 1/2007 Thirkettle et al.
7,178,534 B2 2/2007 Garman
7,337,965 B2 3/2008 Thirkettle et al.
7,431,654 B2 10/2008 Ochi
7,445,550 B2 11/2008 Barney et al.
7,488,231 B2 2/2009 Weston
7,500,917 B2 3/2009 Barney et al.
7,524,246 B2 4/2009 Briggs
7,572,191 B2 8/2009 Weston
7,614,958 B2 11/2009 Weston
7,674,184 B2 3/2010 Briggs
7,749,089 B1 7/2010 Briggs
7,850,527 B2 12/2010 Barney et al.
7,878,905 B2 2/2011 Weston et al.
7,896,742 B2 3/2011 Barney et al.
8,012,031 B2 9/2011 Stuart
8,021,236 B2 9/2011 Bloom
8,021,239 B2 9/2011 Weston
8,226,493 B2 7/2012 Briggs
8,721,465 B2 5/2014 Hunter
8,821,304 B2 9/2014 Ensing
9,396,618 B2 7/2016 Weston
9,517,420 B2 12/2016 White
2002/0032067 A1 3/2002 Barney
2003/0073505 A1 4/2003 Tracy
2003/0190967 A1 10/2003 Barney
2003/0195046 A1 10/2003 Bartsch
2004/0033833 A1 2/2004 Briggs
2004/0077423 A1 4/2004 Weston et al.
2005/0059503 A1 3/2005 Briggs
2005/0138851 A1 6/2005 Ingraselino
2007/0066396 A1 3/2007 Weston et al.
2009/0051653 A1 5/2009 Weston
2009/0156309 A1 6/2009 Weston et al.
2010/0056285 A1 3/2010 Weston et al.
2010/0203932 A1 8/2010 Briggs
2010/0273556 A1 10/2010 Briggs et al.
2011/0081970 A1 4/2011 Barney et al.

FOREIGN PATENT DOCUMENTS

DE 38 12 435 C1 9/1989
DE 39 10679 A1 10/1990

(56) References Cited

FOREIGN PATENT DOCUMENTS

| | | | |
|---|---|---|---|
| FR | 2.031.920 | A5 | 11/1970 |
| JP | 891541 | | 9/1994 |
| WO | 90/07961 | | 7/1990 |
| WO | 96/29120 | | 9/1996 |
| WO | 97/06867 | | 2/1997 |
| WO | 99/32202 | | 7/1999 |
| WO | 98/36812 | | 8/2018 |

* cited by examiner

INTERACTIVE PLAY CENTER WITH INTERACTIVE ELEMENTS AND CONSEQUENCE ELEMENTS

CROSS REFERENCE TO RELATED APPLICATIONS

This application claims the benefit of U.S. Provisional Patent Application Ser. No. 62/080,895, filed on Nov. 17, 2014, entitled "INTERACTIVE PLAY CENTER WITH USER-CONTROLLED NOZZLES," which is hereby incorporated by reference in its entirety.

BACKGROUND

1. Field of the Invention

The present invention relates to a method and system for a play center amusement attraction configured to be traversed by multiple users. More particularly, the present invention relates to a method and system for an interactive play center that includes pedestals configured for user manipulation that causes jets or streams of water to flow in response to user input thereto.

2. Description of the Related Art

Play structures configured to engage multiple children or adults simultaneously have become increasingly popular at waterpark and other entertainment venues. Such play structures allow for multiple users to participate thereon simultaneously. Amusement parks, waterparks, and/or other venues are constantly on the lookout for new and/or exciting manners of play that may be installed or designed for their guests in order to keep customer enjoyment and satisfaction high, driving additional traffic and interest in those respective venues. Desirably, play structure design may be improved by allowing activities performed by one user to impact activity of another user, thereby promoting interaction among various participants. In one desirable situation, an improved play structure may be manufactured, designed, or operated such that a user at one area or location of the play structure is allowed to impact activity at a different area or location of the play structure. Such a play structure may desirably be designed, manufactured, or operated with the above interactivity even if the two areas or locations are not immediately adjacent to one another. In another desirable situation, an improved play structure may be manufactured, designed, or operated such that an activity performed by one user may not be entirely clear to that user, or to other users, what consequence will stem from performance of the activity due to a lack of indication (e.g., visual, audible, or otherwise) that informs the user prior to activity. Desirably, such designs, manufactures, and/or operations would be safe and inexpensive and/or not require excessive mechanical components to facilitate such features.

SUMMARY

The present invention is related to an interactive play center having various elements, such as user-interfaceable elements or structures that, when manipulated, cause an activity or consequence within the interactive play center. In one embodiment, an interactive play center may include a first interactive element configured to be interacted with by a user, and a first consequence element configured to activate based upon the first interactive element being interacted with by the user. Prior to interaction by the user with the first interactive element, there may be no indication to the user that the first consequence element is configured to activate based upon the first interactive element being interacted with by the user.

In another embodiment, an interactive play center may include a first interactive element configured to be activated, a first consequence element configured to activate based upon activation of the first interactive element, a pipe connected with the first consequence element and configured to provide a flow of fluid to the first consequence element, and a valve configured to reduce the flow of fluid to the first consequence element if the first interactive element is not activated. Prior to activation of the first interactive element, there may be no indication that the first consequence element is configured to activate based upon the first interactive element being activated.

In still another embodiment, a structure for an interactive play center for providing a flow of fluid therethrough may include a ground surface having a reservoir of fluid stored thereunder, a first plate having a first opening therein, the first plate connected with the ground surface, and a second plate having a second opening therein, the second plate connected with the ground surface. At least a portion of the first opening and at least a portion of the second opening may overlap such that at least some of the fluid from the reservoir is configured to travel through the overlapping portion of the first opening and the second opening.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1:
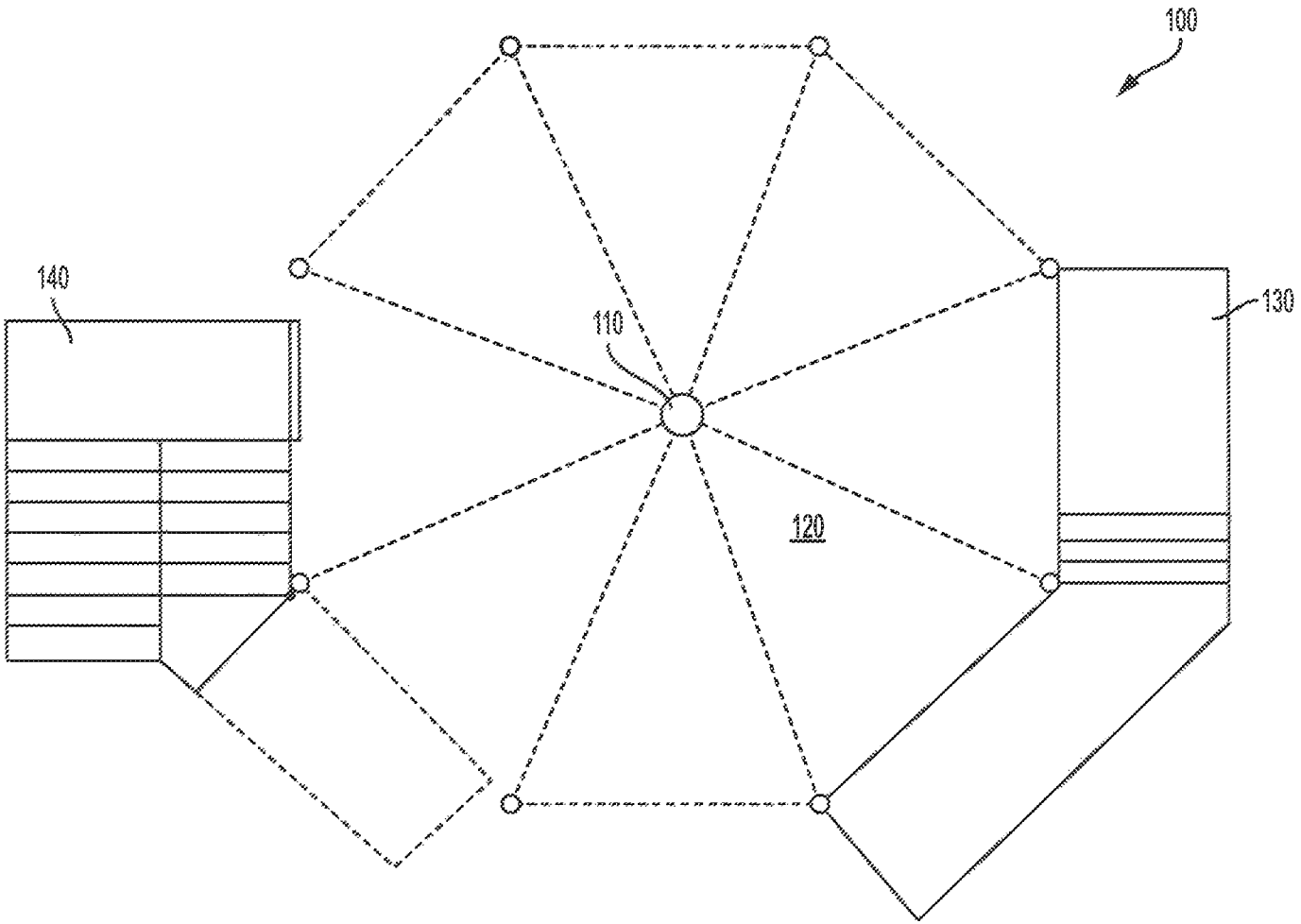
FIG. 1 shows a schematic top view of an interactive play center according to an embodiment of the present invention.

FIG. 1 shows a schematic top view of an interactive play center or structure 100. As illustrated, the interactive play center or structure 100 may be substantially circular or orthogonal in shape and contain a central column or pole 110 with a surrounding area 120 disposed for various play and/or interactive or consequence elements, as discussed in greater detail throughout. For example, a user at one location of the interactive play center or structure 100 may be permitted to interact with an interactive element (e.g., a pedestal with a manipulatable element, such as a button) that is configured to cause a corresponding activity or consequence in one or more locations of the interactive play center or structure 100. Any of a variety of possible activities or consequences may result from this user participation (e.g., emitting a stream of water from a nozzle or other jet element or component). In certain embodiments, the activity may occur at the same location or a substantially adjacent location as the interactive element.

In certain embodiments, the interactive play center or structure 100 may span across multiple floors and/or elevations. As illustrated, one or more platforms 130 and/or stairways 140 may also be included in the interactive play center or structure 100 (e.g., disposed at a perimeter of the area 120) in order to provide a path for users to enter and/or exit from the various areas and/or elevations of the interactive play center or structure 100. As discussed throughout, piping or other systems for the transfer of water, air, or any other type of fluids (and/or electrical signals or other operative systems) may be hidden from user view (for example, located underneath a floor of the interactive play center or structure 100 and/or disposed throughout the structural elements used for the building of the interactive play structure 100 itself (e.g., a column like center column 110 and/or columns or beams used for supporting the one or more platforms 130 or stairways 140, within handrails, wall panels, etc.).

Although certain embodiments specifically illustrated and discussed throughout for the purposes of creating seemingly "random" or unpredictable functionality, a variety of possible interactive elements and/or connections between an interactive element and a resulting consequence may be used in alternative embodiments. For example, in one embodiment, the appearance of randomness of consequence based upon user interaction may result from unfamiliarity of the user with the specifics of the interactive play center or structure and how its operation is constructed, even if such operation is not actually random (e.g., a particular interactive element, such as a button, may always cause a particular consequence or event, but such operation may not be made explicitly clear to users, causing users to experiment and test out various interactive elements to determine its effect). In alternative embodiments, consequences from user interaction with a particular interactive element may be truly random (e.g., an electronic, computerized, or other system may randomize the resulting effect from interaction with a particular interactive element so that it cannot be learned by a user). Furthermore, although many embodiments described throughout focus upon mechanical construction of interactive elements, consequence elements, and/or their interfacing with one another, alternative embodiments may utilize electrical systems or computerized systems to control operation (e.g., via electronically controlled valves and/or other devices).

Likewise, although many embodiments described throughout focus upon specific examples of interactive elements and/or consequence elements (buttons, levers, dials, fluid nozzles or jets, etc.), alternative embodiments may utilize any of a variety of possible elements designed to be interacted with by one or more users and/or elements designed to perform an activity in response to user input and/or automatically. For example, foot pedals, sliding tiles, puzzle elements, etc. and a variety of possible valves or other control mechanisms may be used as desired.

Figure 2A:
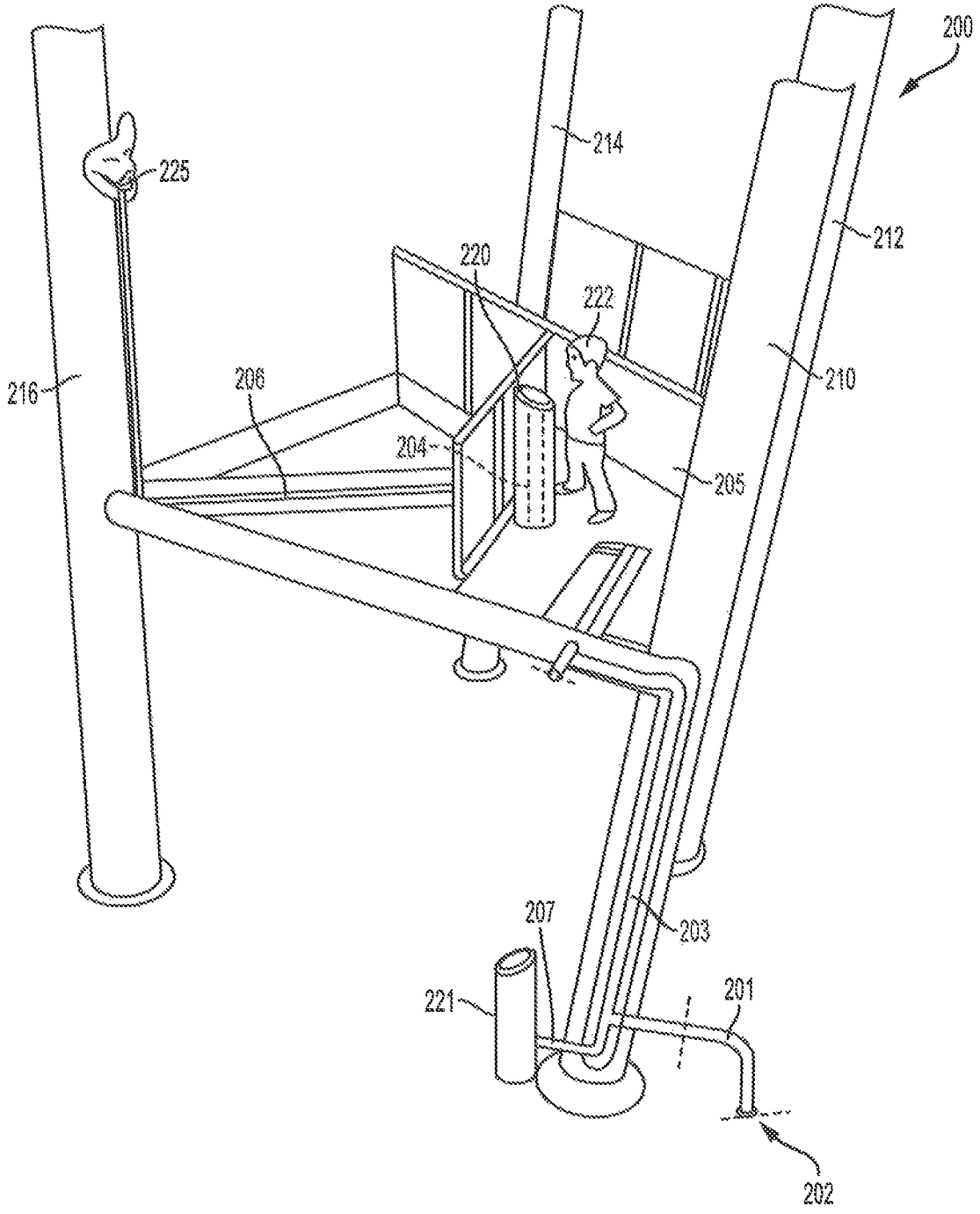
FIG. 2A shows a perspective view of a portion of an interactive play center with user controlled consequence elements according to an embodiment of the present invention.
Figure 2B:
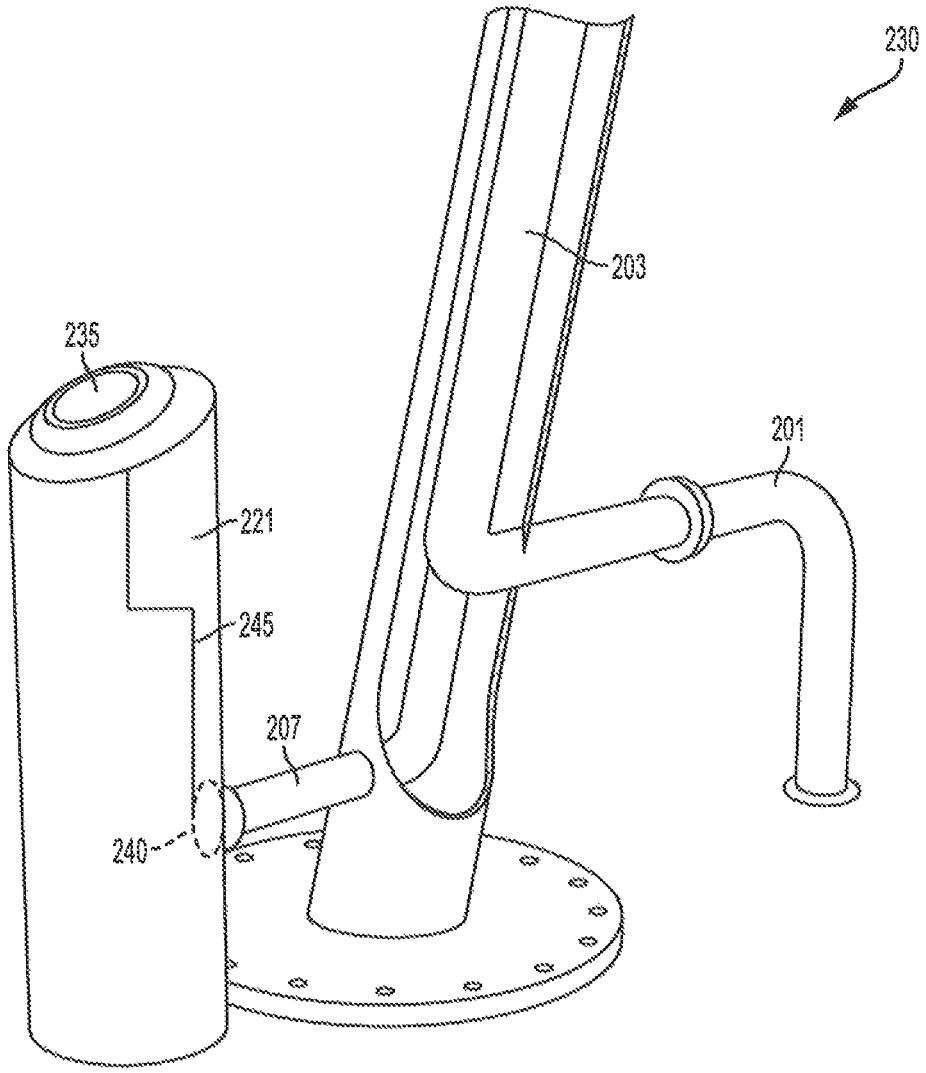
FIG. 2B shows a zoomed in view of a portion of the interactive play center of FIG. 2A and showing an interactive structure for user interaction according to an embodiment of the present invention.
Figure 2C:
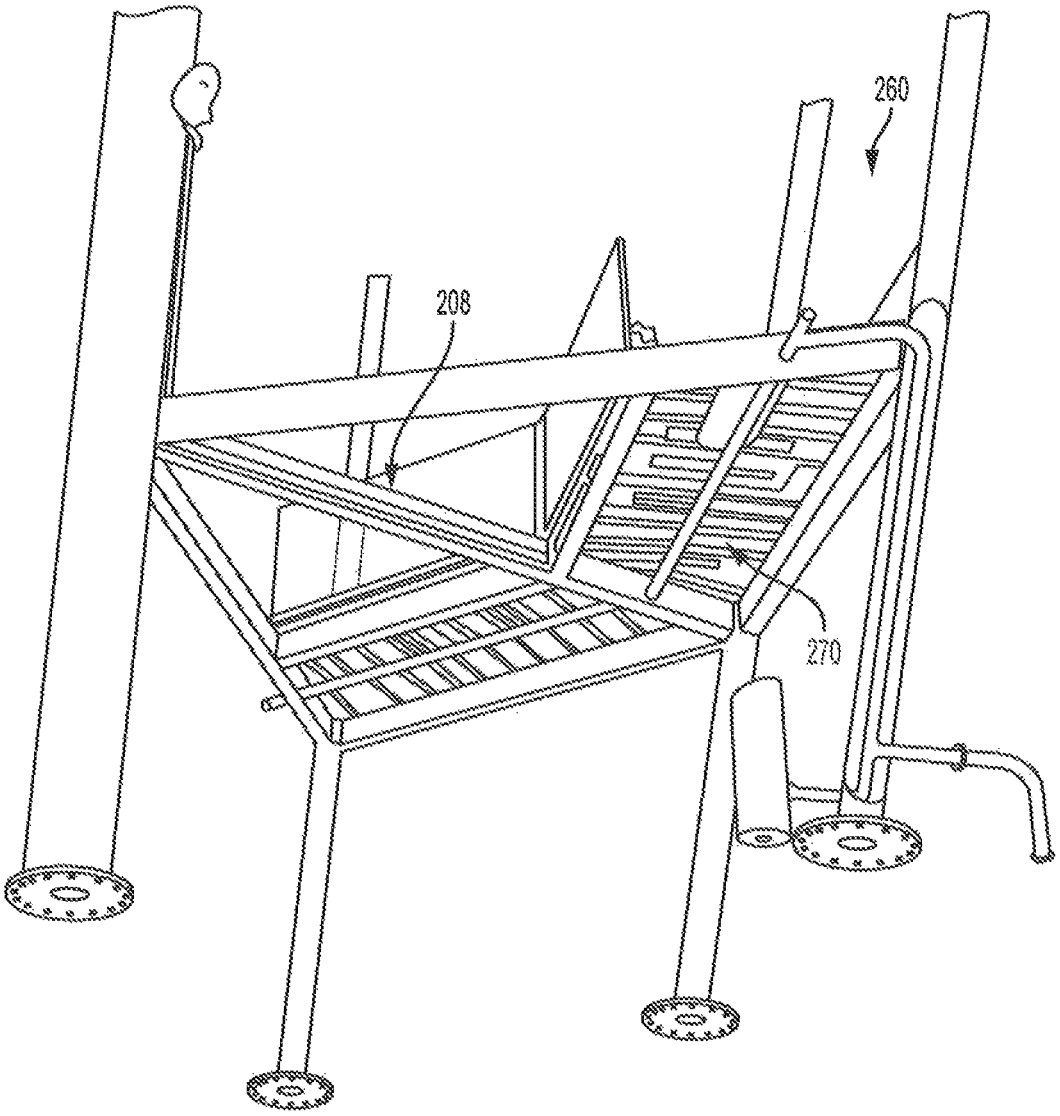
FIG. 2C shows a lower perspective view of the interactive play center of FIG. 2A according to an embodiment of the present invention.

FIGS. 2A-C illustrate various views of portions or components of an interactive play center having a piping system for the flow and/or control of water or other fluid therethrough. FIG. 2A shows a portion of the interactive play center 200 including a platform 205 and a plurality of columns (210, 212, 214, 216) either supporting the platform for a user to traverse and/or for placement of additional equipment as discussed further herein. A first pipe segment 201 for flowing water, air, or other fluid therein is shown connected between a ground, floor, or lower level 202. In one embodiment, the lower level 202 may allow for the first pipe segment 201 to be in communication with a pumping system and/or reservoir located below the lower level 202 for storage and/or circulation of the water, air, or other fluid that is to be disposed through the first pipe segment 201 and to various other equipment of the interactive play center 200.

A second pipe segment 203 is also shown connected with the first pipe segment 201 for similarly flowing water, air, or other fluid therethrough from the first pipe segment 201 to the second pipe segment 203 or vice versa. In certain embodiments and as shown, the second pipe segment 203 (and/or any number of other pipe segments) may be at least partially disposed within a column of the interactive play structure (here, column 210). In this fashion, the second pipe segment 203 may be hidden from view, for example, to increase the aesthetics of the interactive play structure 200. In certain embodiments, the column 210 (or other columns) may be hollow or include a hollow pipe-like section during manufacture so as to act as a portion of the second pipe segment 203 (or other pipe segments) without requiring that the second pipe segment 203 or a portion thereof actually be a separate and distinct pipe that is then coupled or otherwise disposed within the column 210.

A third pipe segment 204 is similarly connected with the second pipe segment 203 for the flowing of water, air, or other fluid therebetween. As illustrated, the third pipe segment 204 is configured to be at least partially within an interactive structure 220 that may be manipulated or otherwise interacted with by a user 222. Any of a variety of possible types of devices may be used for the interactive structure 220, for example a pedestal as discussed throughout and as specifically illustrated in the embodiment of FIG. 2A.

As shown the interactive structure 220 is configured to interface with and/or control the flow of the water, air, or other fluid that is permitted through the third pipe segment 204 For example, the interactive structure 220 may include a user-manipulatable element, such as a button or other control that can be manipulated by a user in order to allow a flow of water from the third pipe segment through to a fourth pipe segment 206. In one embodiment, this may be a valve positioned, for example, between the third pipe segment 204 and the fourth pipe segment 206 that, when opened, permits water to flow from the third pipe segment 204 to the fourth pipe segment 206, the valve's configuration being based upon user interaction with the interactive structure 220. Thus, when a user successfully manipulates the interactive structure 220 (e.g., by pressing the button or control), the valve may be opened and water, air, or other fluid allowed to flow through the now-open valve.

The fourth pipe segment 206 is connected with the third pipe segment 204 for the flowing of water, air, or other fluid therebetween, as previously discussed. A consequence element 225 is connected with the fourth pipe segment 206. The consequence element 225 may be any of a variety of devices that perform some consequence or activity or action based upon the flow of water, air, or other fluid thereto. For example, as illustrated in FIG. 2A, the consequence element 225 may be a water nozzle or jet that sprays water outward upon a flow of water being present at its inlet. Thus, with reference to the above discussion, when the user 222 appropriately interacts with the interactive structure 220 to provide a flow of water, air, or other fluid through pipe segment 204 to pipe segment 206, such water, air, or other fluid is caused to be emitted from the consequence element 225.

The consequence element 225 may be directed to point at or in a vicinity of one or more locations of the interactive play center, for example, at or near interactive structures (e.g., pedestals) or other areas of user activity. In this fashion, users at various locations along the interactive play center can cause other users in different areas of the play center to become sprayed with water. The consequence element 225 may be positioned or configured in any of a variety of ways (e.g., on a column, namely column 216 as shown, on a floor or ceiling element, and/or on any other element such that it may perform an action upon the user 222, or perform an action directed at some other location. Multiple consequence elements may be utilized for a single interactive structure or for multiple interactive structures in various alternative embodiments. In certain embodiments, it may be made apparent to a user when and which consequence element is expected to be operated based upon manipulation of a particular interactive structure to provide a level of certainty to users (e.g., a visible color-coded pipe extending from a particular interactive structure to a particular consequence element). In alternative embodiments, certain consequence elements may be hidden and/or it may not be made apparent when or why one will become active, lending to a sense of uncertainty and potentially increased enjoyment while playing on an interactive structure.

FIG. 2A also shows a fifth pipe segment 207 for flowing water according to an embodiment of the present invention that is connected with a second interactive structure 221. As illustrated, the fifth pipe segment 207 is connected with the second pipe element 203. In one example, the second interactive structure 221 may be manipulated by a user in order to cause a valve connecting the first pipe element 201 and the second pipe element 203 to be open or closed. Upon successfully manipulating the second interactive structure 221, a valve may be caused to open between the first and second pipe segments (201, 203), thus allowing water, air, or other fluid to flow from the first pipe segment 201 to the second pipe segment 203.

If the first interactive structure 220 is also successfully manipulated the water, air, or other fluid may then also be permitted to flow from the second pipe element 203 through the third pipe element 204 and through the fourth pipe element 206. Thus, in such an embodiment, in order for the consequence element 225 to be active, successful manipulation of both the interactive structure 220 and the second interactive structure 221 must be accomplished simultaneously, further lending to the appearance of confusion or sporadicness of the interactive play structure 200 and/or to promote cooperation that must be attempted among participants. Any of a variety of different water flow schemes may be provided in an alternative embodiment, requiring simultaneous manipulation of one or more interactive elements or not. For example, successful manipulation of the second interactive structure 221 may cause water, air, or other fluid by itself, to flow from the first pipe segment 201 through to the fourth pipe segment 206, without requiring any successful manipulation of the interactive structure 220. In such an embodiment, for example, the interactive structure 220 may control a valve elsewhere in the play structure (e.g., not a valve located between the third pipe segment 204 and the fourth pipe segment 206).

FIG. 2B shows a zoomed-in perspective view 230 of a portion of the interactive play center 200 of FIG. 2A and focused upon the second interactive structure 221 for flowing water, air, or other fluid according to an embodiment of the present invention. As shown, and as discussed in greater detail throughout, a button, handprint-switch, or other user-manipulatable element 235 is disposed on the second interactive structure 221 (for example, on a top or side surface). Manipulation of this manipulatable element 235 causes water to flow through various pipe segments as desired (e.g., from the first pipe second 201 to the second pipe segment 203 via a valve 240 as previously discussed). Any of a variety of devices may comprise the interactive structure 221. Indeed, in certain embodiments, the various interactive structures may alternatively or additionally be elements that do not require any specific user interaction (e.g., may be proximity sensors, laser beams that sense when a user crosses the beam, etc.). For example, wiring or other mechanical connections 245 linking the manipulatable element 235 and the valve 240 may be provided within a pipe segment (e.g., the fifth pipe segment).

FIG. 2C shows a rear-perspective 260 view of a portion of the interactive play center 200 of FIG. 2A according to an embodiment of the present invention. As can be seen from this illustration, any of a variety of pipe segment interconnections may be made in order to flow water, air, or other fluid according to various desired control schemes from any of a variety of valves and/or interactive elements located throughout the play center 200. Columns, platforms, and/or other support beams may be used to either connect the various interconnected pipe segments thereto or therein for accommodating the wiring and/or flow of water or other fluids. A plurality of the same or different interactive structures or other elements may be disposed at varying locations (e.g., near or adjacent one another or otherwise) through the interactive play structure 200. Piping may be made visible in certain embodiments so that users can more easily predict a consequence based upon their interactions or may be hidden (270, 280) within or under platforms, within columns or other beams, etc. to promote an element of surprise for participants for all or some of the interactive structures.

Figure 2D:
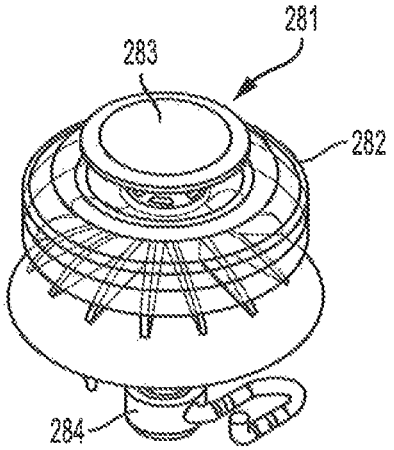
FIG. 2D shows a perspective view of a manipulatable element for use in an interactive play center or structure according to an embodiment of the present invention.

FIG. 2D shows a perspective view of an embodiment of a manipulatable element 281 (e.g., the manipulatable element 235) that may be disposed or included as part of an interactive structure (e.g., the interactive structure 220 and/or 221 previously discussed). In the embodiment shown, the manipulatable element 281 may include a manipulatable portion 283 (e.g., a button, a plate, button, and/or surface that may be pressed by a user), a housing 282 (e.g., made of transparent, or semi-transparent material such that a user can view one or more inner elements), and a valve 284 or other control element that is configured to control a flow of fluid based upon a user's interaction with the manipulatable portion 283. In an alternative embodiment, any of a variety of other manipulatable portions or elements (e.g., switches, ropes, dials, etc.) or elements having differing characteristics (e.g., housings made of non-transparent materials, etc.) or operation may be used. The manipulatable element 281 may be disposed on a pedestal (same or similar as previously discussed) and/or other places (e.g., in a wall, on a handrail, etc.). The pedestal may be any of a variety of heights, dimensions, or configurations (for example, may be 30-inches tall to allow for usage by children). Different heights, dimensions, or configurations may be used in same or different interactive play structures based upon desired participant characteristics.

Figure 2E:
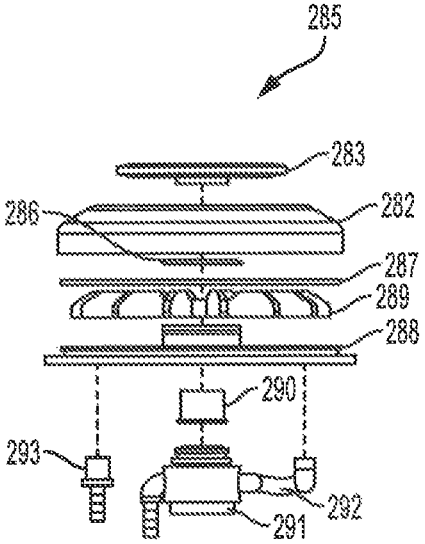
FIG. 2E shows a disconnected side view of the components making up the manipulatable element of FIG. 2D for use in an interactive play center or structure according to an embodiment of the present invention.
Figure 2F:
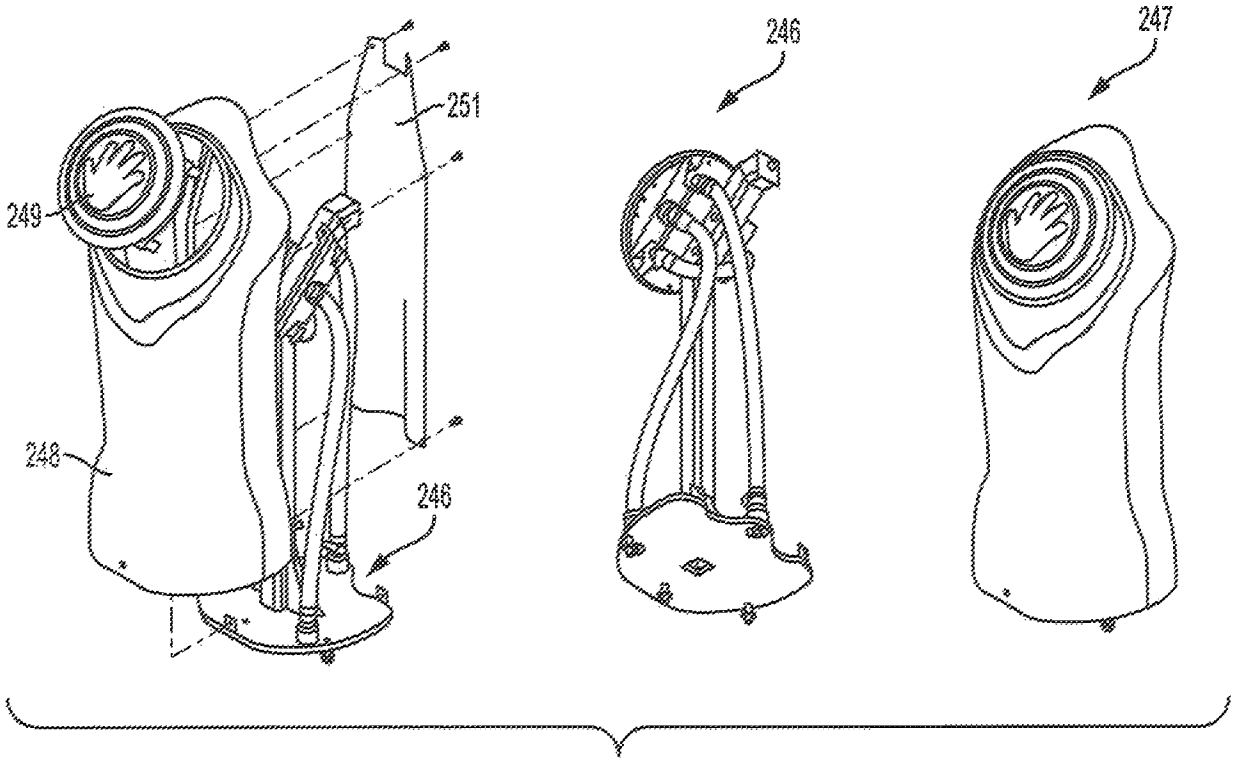
FIG. 2F shows a plurality of views of components making up a manipulatable element for use in an interactive play center according to an embodiment of the present invention.

FIG. 2E shows the manipulatable element 281 in more detail via a disconnected side view 285 of its constituent parts. As shown, the manipulatable portion 283 extends out of the housing 282 so that it may be interacted with by a user. The housing 282 may be constructed of one or more materials that allow the user to view elements through the housing 282. One or more connectors (286, 287) (e.g., O-rings) are connected with the manipulatable portion 283 and/or the housing 282, for example to aid in containing fluids within the housing 282 and/or to aid in preventing outside contaminants to enter the housing 282. A base 288 for the manipulatable portion 283 is connected with the manipulatable portion 283 and a turbine blade 289 is disposed therebetween and within the housing 282. Thus, in the embodiment shown, a user may be able to view the turbine blade 289 through the housing 282.

A connecting element 290 (e.g., a push-button rod) is connected with the manipulatable portion 283. For example, upon a user pressing down upon the manipulatable portion 283, the connecting element 290 may correspondingly move and exert a force upon a portion of a valve 291 (e.g., a PVC push valve). As previously discussed, user manipulation of the manipulatable portion 283 may cause the valve 291 to then correspondingly open, allowing water, air, or other fluid to flow between a hose or tube 292 to a second hose or tube 293 (e.g., in conjunction with connecting fasteners such as brass or other hose barbs. In this fashion, when the water, air, or other fluid travels between the hose or tube 292 and the second hose or tube 293, the turbine blade 289 will correspondingly be caused to spin or otherwise move due to the flow of water, air, or other fluid.

In certain embodiments, this may provide visual stimulation to the user interacting with the manipulatable portion 283 that their interaction is having an effect. Alternative embodiments may utilize any of a variety of visual, audible, tactile, or other stimulations in reaction to a user's manipulation of some component of the manipulatable element 281. For example, lights, sounds, vibrations, etc. may be generated in varying embodiments. In other embodiments, no stimulation may be detectable by a user (e.g., the housing 282 may not allow a user to view through it).

Figure 2G:
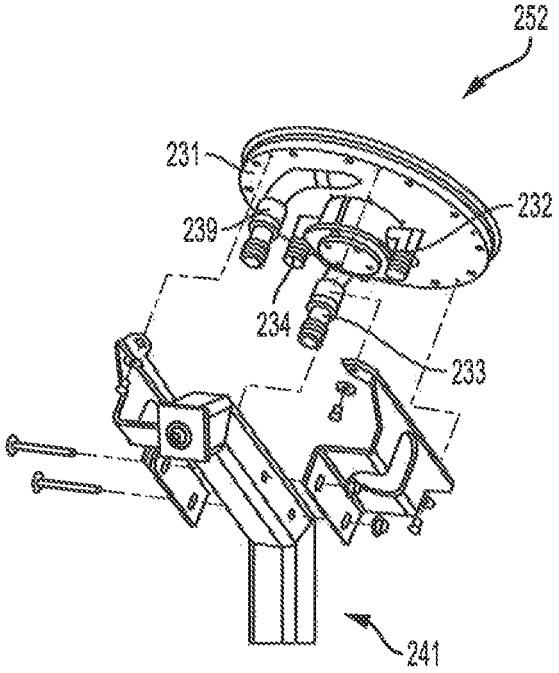
FIG. 2G shows a perspective view of a 3-way fluid transmittal manipulatable element for use in an interactive play center according to an embodiment of the present invention.

FIG. 2G shows a plurality of views of components making up a manipulatable structure 247 for use in an interactive play center. Certain of the features and/or operation of the manipulatable structure 247 may be the same as or similar to those discussed through. As shown, the manipulatable structure 247 may be made up of a connection of elements. For example, as shown, an interactive element 249, such as a button or other user-manipulatable device may be a connected with a front portion 248 of a pedestal or other housing and/or a rear portion 251 of the pedestal or other housing. Such housing may be used to elevate the interactive element 249 above a ground level for convenience of a user to interact with. Various other components 246, such as piping, valves, and/or other elements or connectors may also be configured to be located within the housing and connected with the interactive element 249.

Thus, in one embodiment, a user that interfaces with the interactive element 249 may cause a fluid to flow through one or more pipes or other the components 246 in response thereto.

Figure 2H:
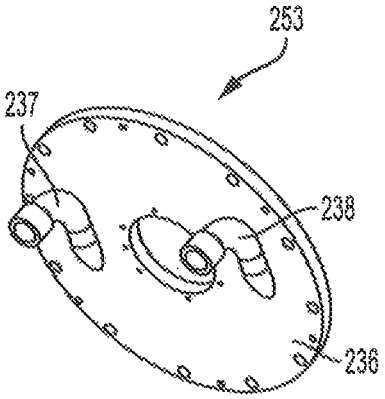
FIG. 2H shows a perspective view of a 1-way fluid transmittal manipulatable element for use in an interactive play center according to an embodiment of the present invention.

As discussed, manipulatable elements for user interaction may take a variety of forms and/or control one or more of a variety of possible consequence elements. For example, FIG. 2H shows a perspective view of a 3-way fluid transmittal manipulatable element 251. The manipulatable element 251 shown in the embodiment of FIG. 2H is capable of communicating and/or halting fluid from a source, such as a fluid reservoir, via a source piping input 239 to three possible consequence elements or travel paths, via a first piping output 232, a second piping output 233, and a third piping output 234. The manipulatable element 251 may connect with a system or bracket 241 that is configured to orient the manipulatable element 251 at a desired height and/or in a desired configuration. Similarly, the embodiment of FIG. 2I shows a 1-way fluid transmittal manipulatable element 253, but the manipulatable element 253 is configured to communicate and/or halt fluid between a piping input 237 and a piping output 236.

Any of a variety of possible configurations for a pedestal with an interactive activation button for use controlling water in an interactive play center having one or more features previously discussed. For example, the activation button may be disposed upon a horizontal or sloped surface at a particular height for use by an individual. The activation button of the interactive element may be disposed at a 30 degree-45 degree angle with respect to the horizontal in order to allow for easier pressing by a user. In one embodiment, the interactive element may be 36 inches high. Varying degrees of force may be configured to be required by the user before the button is successfully actuated. Lower elevations of the button and/or requiring greater or lesser amount of force may be used in alternative embodiments. In one example, the pedestal may be 30 inches high. In certain embodiments, the pedestal may be adjustable such that one pedestal may be provided that accommodates a variety of different heights that may then be customized for a particular application.

Although the previous discussions have focused mainly upon pedestal or button type structures for user interaction, any of a variety of possibilities may be used in alternative embodiments. Different structures may be used at different locations within a same interactive play center. With reference to FIGS. 3A-3E, one possible interactive structure may be an interactive handrail. Operation and/or features of an interactive handrail and/or its use within an interactive play structure (e.g., in conjunction with pipe segments and/or valves) may be the same as or similar to those previously discussed.

Figure 3A:
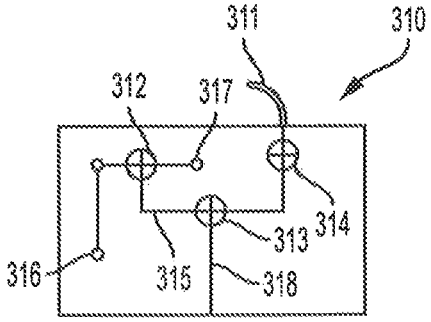
FIG. 3A shows an interactive handrail for flowing of fluid according to an embodiment of the present invention.

In one example, as illustrated in FIG. 3A, an interactive handrail 310 is shown having a single consequence element 311 (e.g., a water jet or nozzle) and three manipulatable elements (312, 313, 314), each or some of the three manipulatable elements (312, 313, 314) having a corresponding valve for controlling a flow of water, air, or other fluid via associated piping 315 that potentially allow for flow between one or more source locations (316, 317, 318) to each other and/or to the consequence element 311.

In certain embodiments, the valve, piping, or other components may be visible or provide stimulation or feedback to a user that is operating one or more of the three manipulatable elements (312, 313, 314) so that the user may be aware of when or what their interactions with the three manipulatable elements (312, 313, 314) are accomplishing. One or more of the corresponding valves may be circular valves in one embodiment, the rotation or other manipulation of one or more of the three manipulatable elements (312, 313, 314) causing a corresponding valve to open or close. This opening and/or closing of valves may allow for different pathways for the flow of water, air, or other fluid therethrough or the halting of such therethrough.

Figure 3E:
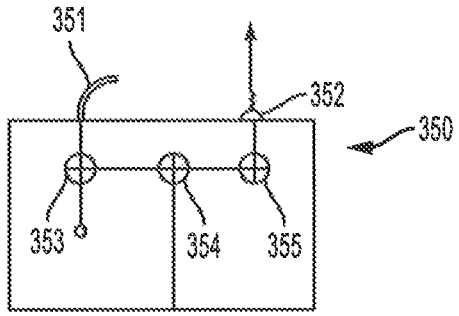
FIG. 3E shows an interactive handrail for flowing of fluid according to an embodiment of the present invention.
Figure 3B:
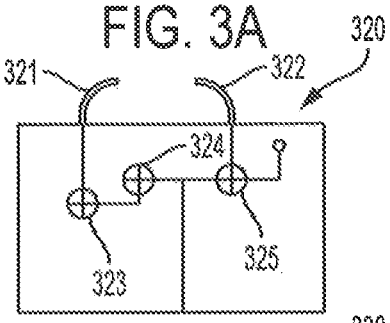
FIG. 3B shows an interactive handrail for flowing of fluid according to an embodiment of the present invention.
Figure 3C:
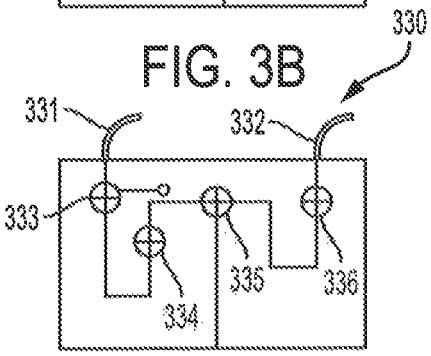
FIG. 3C shows an interactive handrail for flowing of fluid according to an embodiment of the present invention.
Figure 3D:
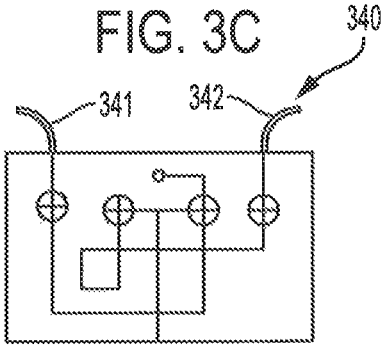
FIG. 3D shows an interactive handrail for flowing of fluid according to an embodiment of the present invention.

Varying embodiments, for example, those shown in FIGS. 3B-3E are similar to FIG. 3A and may contain features that are the same as or similar to previous discussions, but illustrate varying numbers, configurations, and/or types of manipulatable elements, piping, and/or consequence elements. Alternative embodiments may use any of a variety of such numbers, configurations, and/or types as desired. Specifically, FIG. 3B shows an interactive handrail 320 having two consequence elements (321, 322) with three manipulatable elements (323, 324, 325), FIG. 3C shows an interactive handrail 330 having two consequence elements (331, 332) with four manipulatable elements (333, 334, 335, 336), FIG. 3D shows an interactive handrail 340 having two consequence elements (341, 342) with four manipulatable elements (343, 344, 345, 346) but with a different piping configuration than is shown for FIG. 3C, and FIG. 3E shows an interactive handrail 330 having two differing consequence elements (351, 352) with three manipulatable elements (353, 354, 355). In an alternative embodiment, any of a variety of possible interactive elements (e.g., sliding tiles, dials, buttons, switches, levers, etc.) may be used for allowing user interaction. Such embodiments may allow for the creation of "puzzles" that must be correctly solved by a user in order for a flow of water or other consequence event to successfully be activated.

Figure 4:
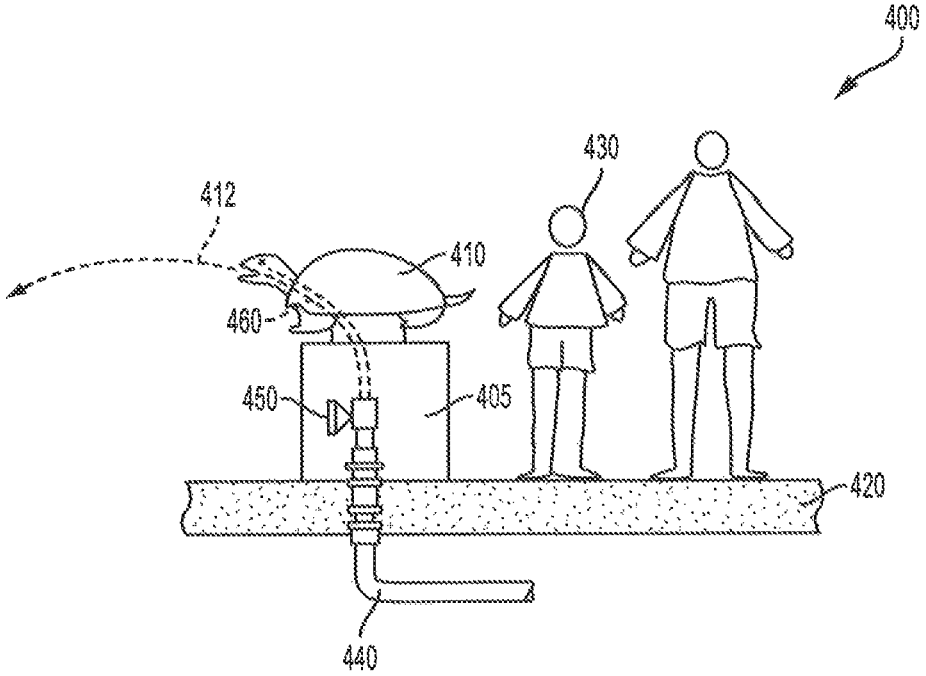
FIG. 4 shows an interactive structure according to an embodiment of the present invention.

FIGS. 4-14 illustrate a variety of other possible interactive structures and/or elements that allow for one or more users to interact therewith and cause a consequence, either in a vicinity of the specific structure being interacted with and/or at another location. As discussed, the activation of such a consequence due to interaction may be made predictable to users (e.g., via visual, audible, tactile, etc.) and/or may be "hidden" such that a given consequence may be surprising to users. FIG. 4 illustrates an interactive structure 400 that includes a base component 405 and a rotatable consequence element 410, illustrated in the embodiment shown as an animal capable of emitting a flow 412 of water or other fluid therefrom. In one embodiment, the base component 405 may be 24 inches by 24 inches. A floor or ground surface 420 is connected with the base component 405 and provides a surface that one or more users 430 may traverse thereon while simultaneously allowing for piping 440 and/or reservoir or fluid storage systems to be disposed thereunder and thus hidden from view and/or from being undesirably interfered with by the one or more users 430.

A valve 450 (such as, in one embodiment, a throttling valve or any other type of valve or restrictor) may be disposed within the base component 405 or another location where the one or more users 430 may not undesirably interfere therewith (e.g., beneath the floor or ground surface 420). A hose or tube 460 is connected with the valve 450 for flowing of water or other fluid therethrough. In one embodiment, the hose or tube 460 may be flexible. Thus, as discussed throughout, the valve 450 may be caused to open and/or close (e.g., via user interaction with some manipulatable element in a nearby or far-off area and/or merely continuously throttle a flow of fluid) to thereby cause water or other fluid to flow through the hose or tube 460. Alternative embodiments may utilize any of a variety of possible configurations or characteristics (e.g., the consequence element 410 may not be rotatable or movable, thus potentially eliminating desire for a flexible hosing leading therethrough). In certain embodiments roofing elements (e.g., translucent, semi-translucent, or non-translucent) may extend over all or a portion of the interactive structure 400 (e.g., to help shield the one or more users 430 in a vicinity of and/or operating the interactive structure 400 from other consequence elements).

Figure 5:
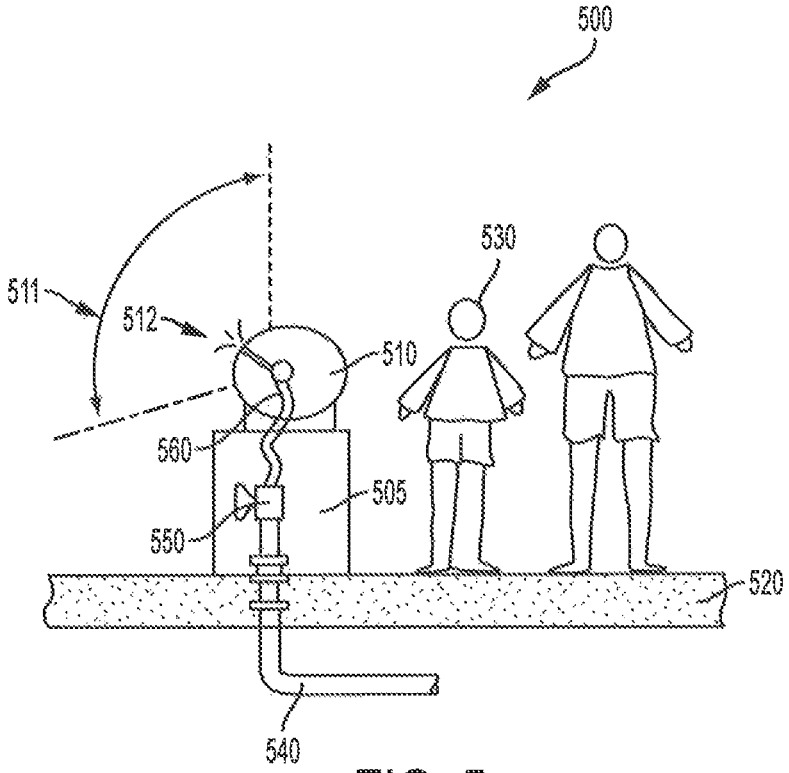
FIG. 5 shows an interactive structure according to an embodiment of the present invention.

FIG. 5 shows another example of an interactive structure 500. Certain features or operation within an interactive play structure may be the same as or similar to those discussed throughout. The interactive structure 500 includes a base component 505 and a rotatable consequence element 510 (such as, in one embodiment, a 15-inch drum shape) that is capable of rotating in a vertical orientation with a predefined radius of swivel or rotation (such as, in one embodiment, 110 degrees) and capable of emitting a flow 512 of water or other fluid therefrom. A floor or ground surface 520 is connected with the base component 505 and provides a surface that one or more users 530 may traverse thereon while simultaneously allowing for piping 540 and/or reservoir or fluid storage systems to be disposed thereunder and thus hidden from view and/or from being undesirably interfered with by the one or more users 530.

A valve 550 (such as, in one embodiment, a throttling valve or any other type of valve or restrictor) may be disposed within the base component 505 or another location where the one or more users 530 may not undesirably interfere therewith (e.g., beneath the floor or ground surface 520). A hose or tube 560 is connected with the valve 550 for flowing of water or other fluid therethrough. In one embodiment, the hose or tube 560 may be flexible. Thus, as discussed throughout, the valve 550 may be caused to open and/or close (e.g., via user interaction with some manipulatable element in a nearby or far-off area and/or merely continuously throttle a flow of fluid) to thereby cause water or other fluid to flow through the hose or tube 560. Alternative embodiments may utilize any of a variety of possible configurations or characteristics (e.g., the consequence element 510 may not be rotatable or movable, thus potentially eliminating desire for a flexible hosing leading therethrough). In certain embodiments roofing elements (e.g., translucent, semi-translucent, or non-translucent) may extend over all or a portion of the interactive structure 500 (e.g., to help shield the one or more users 530 in a vicinity of and/or operating the interactive structure 500 from other consequence elements).

Figure 6:
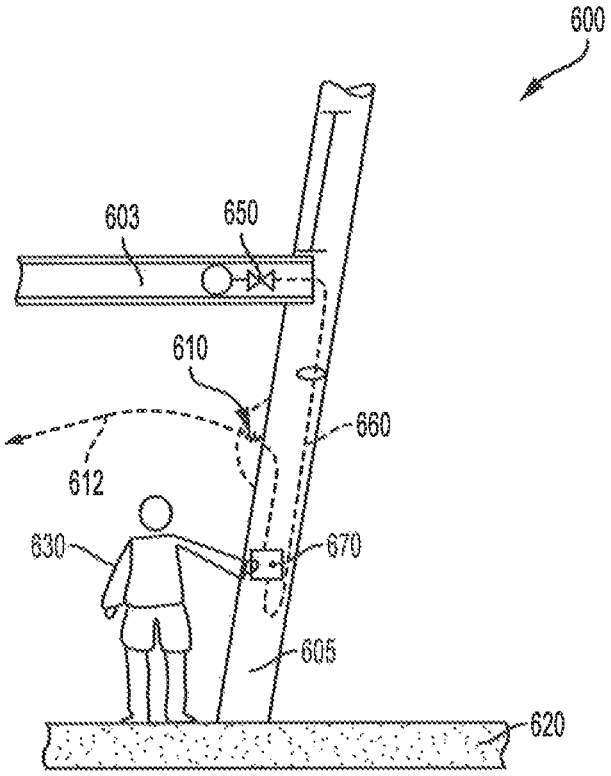
FIG. 6 shows an interactive structure according to an embodiment of the present invention.

FIG. 6 shows another example of an interactive structure 600. Certain features or operation within an interactive play structure may be the same as or similar to those discussed throughout. The interactive structure 600 includes a column component 605 that may (or may not in alternative embodiments) be used for supporting a platform, deck, or other surface 603 of an interactive play center, as previously discussed. In one embodiment, the column component 605 may be a 10-inch, or other dimensioned, angled support pipe. A consequence element 610 (e.g., a hidden and/or themed element, such as an arch jet or nozzle) that is capable of emitting a flow 612 of water or other fluid therefrom. A floor or ground surface 620 is connected with the column component 605 and provides a surface that one or more users 630 may traverse thereon while simultaneously allowing for piping (not shown) and/or reservoir or fluid storage systems to be disposed thereunder and thus hidden from view and/or from being undesirably interfered with by the one or more users 630.

A valve 650 (such as a throttling valve or any other type of valve or restrictor in alternative embodiments) may be disposed within the column component 605 and/or the platform, deck, or other surface 603 (or another location where the one or more users 630 may not undesirably interfere therewith, such as beneath the floor or ground surface 620). A hose or tube 660 (flexible or rigid, etc.) is connected with the valve 650 for flowing of water or other fluid therethrough. A second valve 670 (for example, in one embodiment, a push button valve) that allows for user manipulation in order to open/close the second valve 670 may be connected on the column component 605. Thus, as discussed throughout, the valve 650 and/or the second valve 670 may be caused to open and/or close (e.g., via user interaction with some manipulatable element in a nearby or far-off area and/or merely continuously throttle a flow of fluid) to thereby cause water or other fluid to flow through the hose or tube 660. Alternative embodiments may utilize any of a variety of possible configurations or characteristics.

Figure 7:
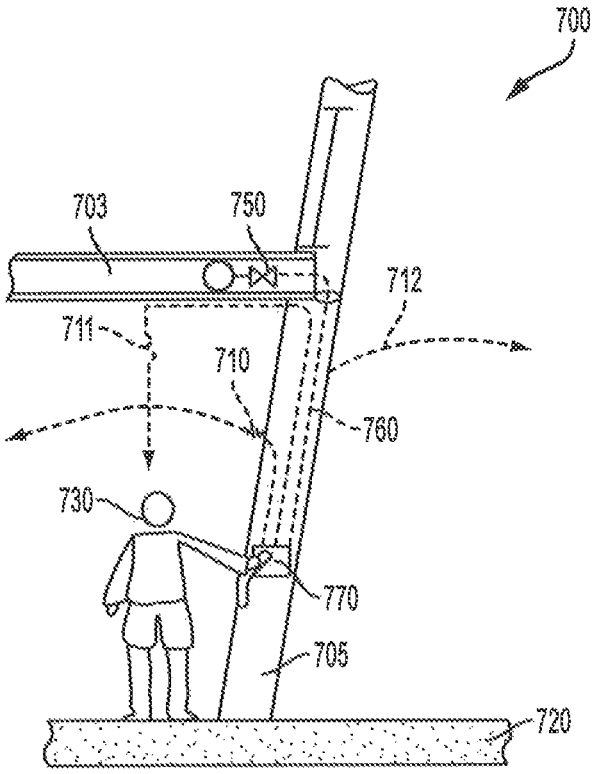
FIG. 7 shows an interactive structure according to an embodiment of the present invention.

FIG. 7 shows another example of an interactive structure 700. Certain features or operation within an interactive play structure may be the same as or similar to those discussed throughout. The interactive structure 700 includes a column component 705 that may (or may not in alternative embodiments) be used for supporting a platform, deck, or other surface 703 of an interactive play center, as previously discussed. In one embodiment, the column component 705 may be a 10 inch, or other dimensioned, angled support pipe. A plurality of flows (710, 711, 712) of fluid, such as air or water, for example via consequence elements like water jets or nozzles), may be hidden or located within themed elements. A floor or ground surface 720 is connected with the column component 705 and provides a surface that one or more users 730 may traverse thereon while simultaneously allowing for piping (not shown) and/or reservoir or fluid storage systems to be disposed thereunder and thus hidden from view and/or from being undesirably interfered with by the one or more users 730.

A valve 750 (such as a throttling valve or any other type of valve or restrictor) may be disposed within the column component 705 and/or the platform, deck, or other surface 703 (or another location where the one or more users 730 may not undesirably interfere therewith, such as beneath the floor or ground surface 720). One or more of a hose or tube 760 (for example, flexible or rigid, etc.) is connected with the valve 750 for flowing of water or other fluid therethrough. A second valve 770 that allows for user manipulation in order to open/close the second valve 770 and/or selectively flow fluid through one or more of the hose of tube 760 may be connected on the column component 705. In one embodiment, the second valve 770 may be a 2-way valve, or any other type of valve. Thus, as discussed throughout, the valve 750 and/or the second valve 770 may be caused to open and/or close (e.g., via user interaction with some manipulatable element in a nearby or far-off area and/or merely continuously throttle a flow of fluid) to thereby cause water or other fluid to flow through the one or more of the hose or tube 760. Alternative embodiments may utilize any of a variety of possible configurations or characteristics.

Figure 8:
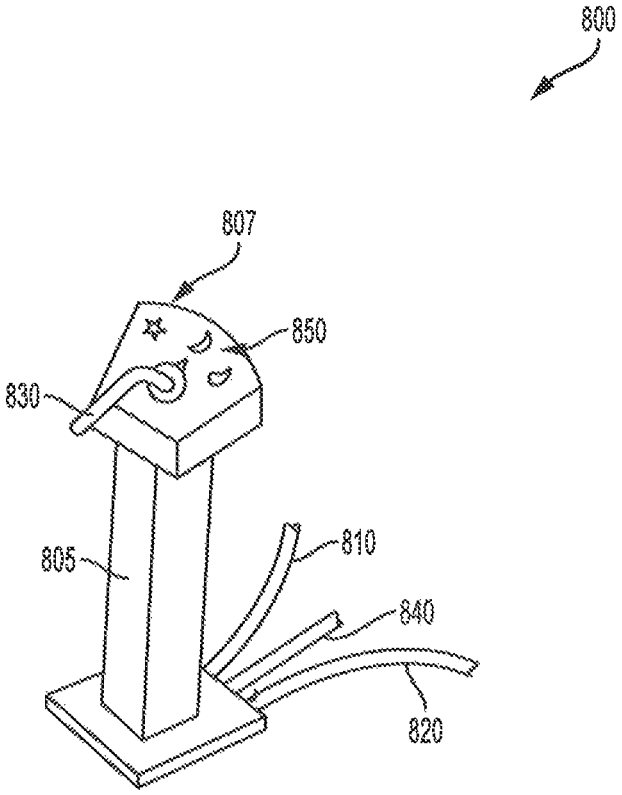
FIG. 8 shows an interactive structure according to an embodiment of the present invention.

FIG. 8 shows another example of an interactive structure 800. Certain features or operation within an interactive play structure may be the same as or similar to those discussed throughout. The interactive structure 800 includes a pedestal base 805 that has an interactive portion 807 for manipulation by a user. A first consequence element (not shown) is connected with a first outlet hose or tube 810 and a second consequence element (not shown) is connected with a second outlet hose or tube 820. Fluid is configured to flow through either the first outlet hose or tube 810, the second outlet hose or tube 820 or both (or neither) of the first and second outlet hoses or tubes (810, 820) in response to user manipulation via the interactive portion 807. For example, a user may manipulate a lever 830 on the interactive portion 807 between a plurality of different positions (for example, in one embodiment, 3 positions) which cooperates with a valve (for example, in one embodiment, a 3-position valve disposed within the pedestal base 805) corresponding to output of fluid from a source of the fluid via inlet hose or tube 840 (e.g., from a reservoir and/or pump and/or pipe located beneath a floor or ground level and/or otherwise outside of view of the users) and to either, neither, or both of the first and second outlet hoses or tubes (810, 820). In certain embodiments, graphics 850 (or other visual, audible, or tactile, etc. feedback in alternative embodiments) on or near the interactive portion 807 or otherwise on the play structure may provide an indication to the user as to expected consequence upon positioning of the lever 830. Alternative embodiments may utilize any of a variety of possible configurations or characteristics.

Figure 9:
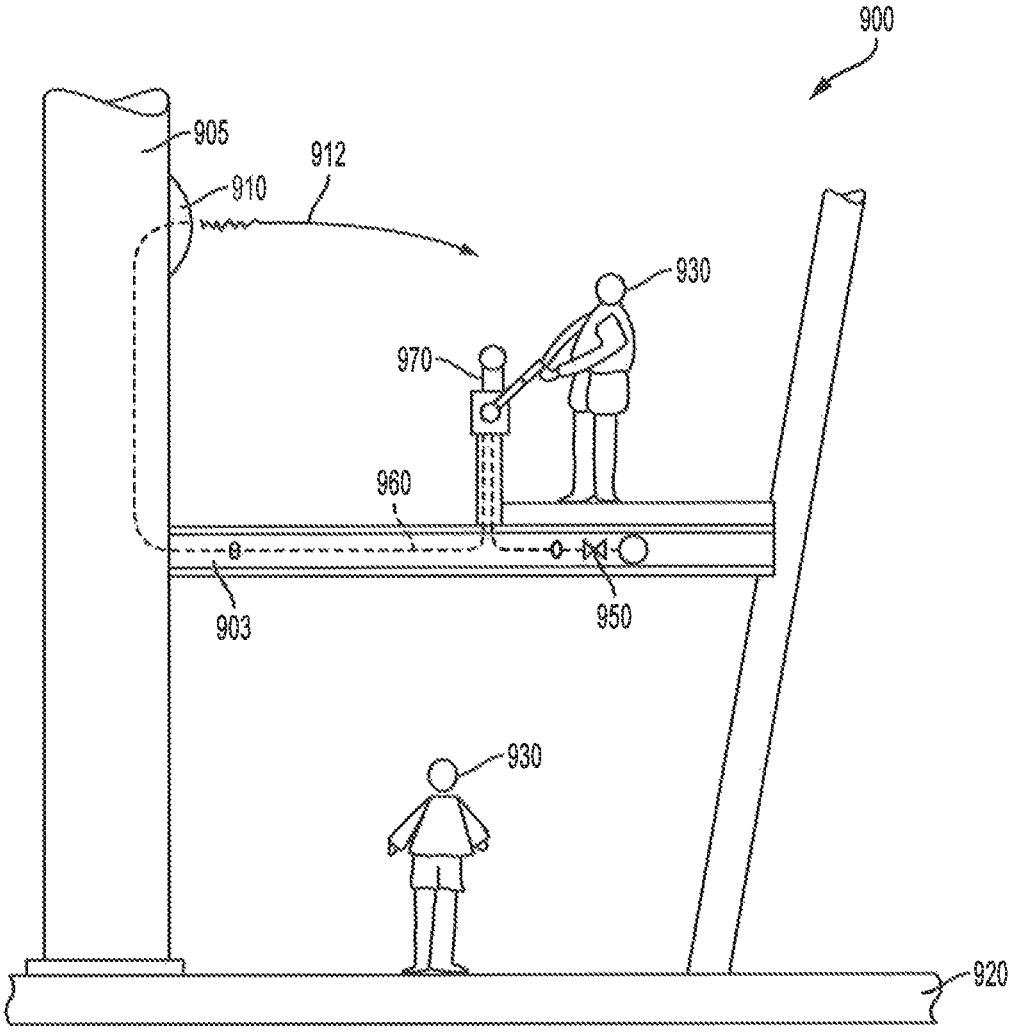
FIG. 9 shows an interactive structure according to an embodiment of the present invention.

FIG. 9 shows another example of an interactive structure 900. Certain features or operation within an interactive play structure may be the same as or similar to those discussed throughout. The interactive structure 900 includes a column component 905 that may (or may not in alternative embodiments) be used for supporting a platform, deck, or other surface 903 of an interactive play center, as previously discussed. A consequence element 910 (for example, in one embodiment, a hidden and/or themed element, such as an arch jet or nozzle) that is capable of emitting a flow 912 of water or other fluid therefrom. A floor or ground surface 920 is connected with the column component 905 and provides a surface that one or more users 630 may traverse thereon while simultaneously allowing for piping (not shown) and/or reservoir or fluid storage systems to be disposed thereunder and thus hidden from view and/or from being undesirably interfered with by the one or more users 930.

A valve 950 (for example, in one embodiment, a throttling valve) may be disposed within the column component 905 and/or the platform, deck, or other surface 903 (or another location where the one or more users 930 may not undesirably interfere therewith, such as beneath the floor or ground surface 920). A hose or tube 960 (for example, flexible or rigid, etc.) is connected with the valve 950 for flowing of water or other fluid therethrough. Thus, as discussed throughout, the valve 950 may be caused to open and/or close (e.g., via user interaction with some manipulatable element in a nearby or far-off area and/or merely continuously throttle a flow of fluid) to thereby cause water or other fluid to flow through the hose or tube 960 when one or more users 930 appropriately manipulate an interactive element 970 (for example, in one embodiment, a lever or dial upon a handrail). Upon such manipulation of the interactive element 970, fluid is permitted to flow through the interactive element 970 and through to the consequence element 910. Alternative embodiments may utilize any of a variety of possible configurations or characteristics.

Figure 10:
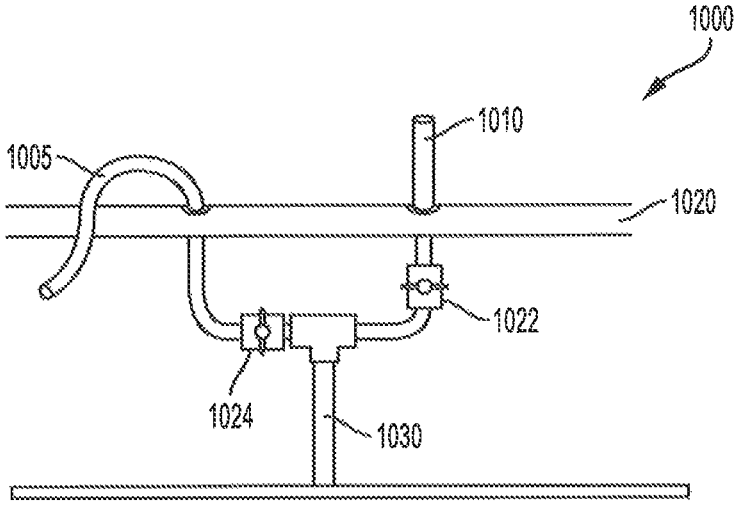
FIG. 10 shows an interactive structure according to an embodiment of the present invention.

FIG. 10 shows another example of an interactive structure 1000. Certain features or operation within an interactive play structure may be the same as or similar to those discussed throughout. The interactive structure 1000 may include a first hose 1005 (e.g., flexible or rigid) and a second hose 1010 (e.g., flexible or rigid) extending from a surface 1020 of the interactive play center (e.g., a wall, panel, or handrail). A plurality of valves (1022, 1024), such as brass or other ball valves, are coupled or otherwise partially contained within the surface 1020, but configured to be manipulated by a user (for example, in one embodiment, a rotational wheel or lever may be connected with one or more of the plurality of valves (1022, 1024) allowing a user to rotate or move the wheel or lever to cause a corresponding change in orientation of one or more of the plurality of valves (1022, 1024)). The first hose 1005 and/or the second hose 1010 are connected with one or more of the plurality of valves (1022, 1024). Fluid (for example, in one embodiment, water) may be provided via piping 1030 that flows through one or more of the plurality of valves (1022, 1024) and eventually to the first and second hoses (1005, 1010). Thus, by manipulating one or more of the plurality of valves (1022, 1024), a user may cause a flow of fluid out of one or more of the first or second hoses (1005, 1010). Alternative embodiments may utilize any of a variety of possible configurations or characteristics.

Figure 11:
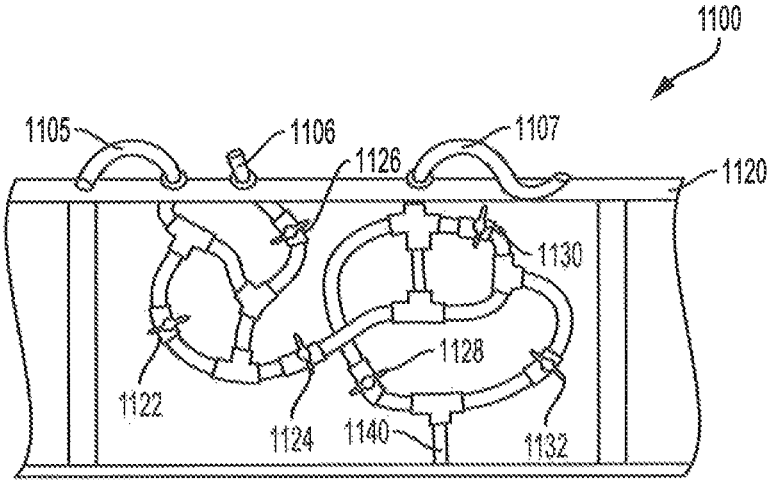
FIG. 11 shows an interactive structure according to an embodiment of the present invention.

FIG. 11 shows another example of an interactive structure 1100. Certain features or operation within an interactive play structure may be the same as or similar to those discussed throughout. The interactive structure 1100 may include a first hose 1105 (e.g., flexible or rigid), a second hose 1106 (for example, in one embodiment, a spout), and a third hose 1107 and a second hose 1110 (e.g., flexible or rigid) extending from a surface 1120 of the interactive play center (e.g., a wall, panel, or handrail that may or may not be translucent in nature). A plurality of valves (1122, 1124, 1126, 1128, 1130, 1132), such as brass or other ball valves, are coupled or otherwise partially contained within the surface 1120, but configured to be manipulated by a user (for example, in one embodiment, a rotational wheel or lever may be connected with one or more of the plurality of valves (1122, 1124, 1126, 1128, 1130, 1132) allowing a user to rotate or move the wheel or lever to cause a corresponding change in orientation of one or more of the plurality of valves (1122, 1124, 1126, 1128, 1130, 1132)).

The first hose 1105, the second hose 1106, and/or the third hose 1107 are connected with one or more of the plurality of valves (1122, 1124, 1126, 1128, 1130, 1132). The amount and/or configuration of the plurality of valves (1122, 1124, 1126, 1128, 1130, 1132) may make for an unapparent cause-and-effect, potentially leading to an uncertain experimentation by users as to which valves must be operated in order to flow fluid to which hoses. Fluid (for example, in one embodiment, water) may be provided via piping 1140 (metal pipes, flexible tubing, etc.) that flows through one or more of the plurality of valves (1122, 1124, 1126, 1128, 1130, 1132) and eventually to the first, second, and third hoses (1105, 1106, 1107). Thus, by manipulating one or more of the plurality of valves (1122, 1124, 1126, 1128, 1130, 1132), a user may cause a flow of fluid out of one or more of the first, second, and third hoses (1105, 1106, 1107). Alternative embodiments may utilize any of a variety of possible configurations or characteristics.

Figure 12:
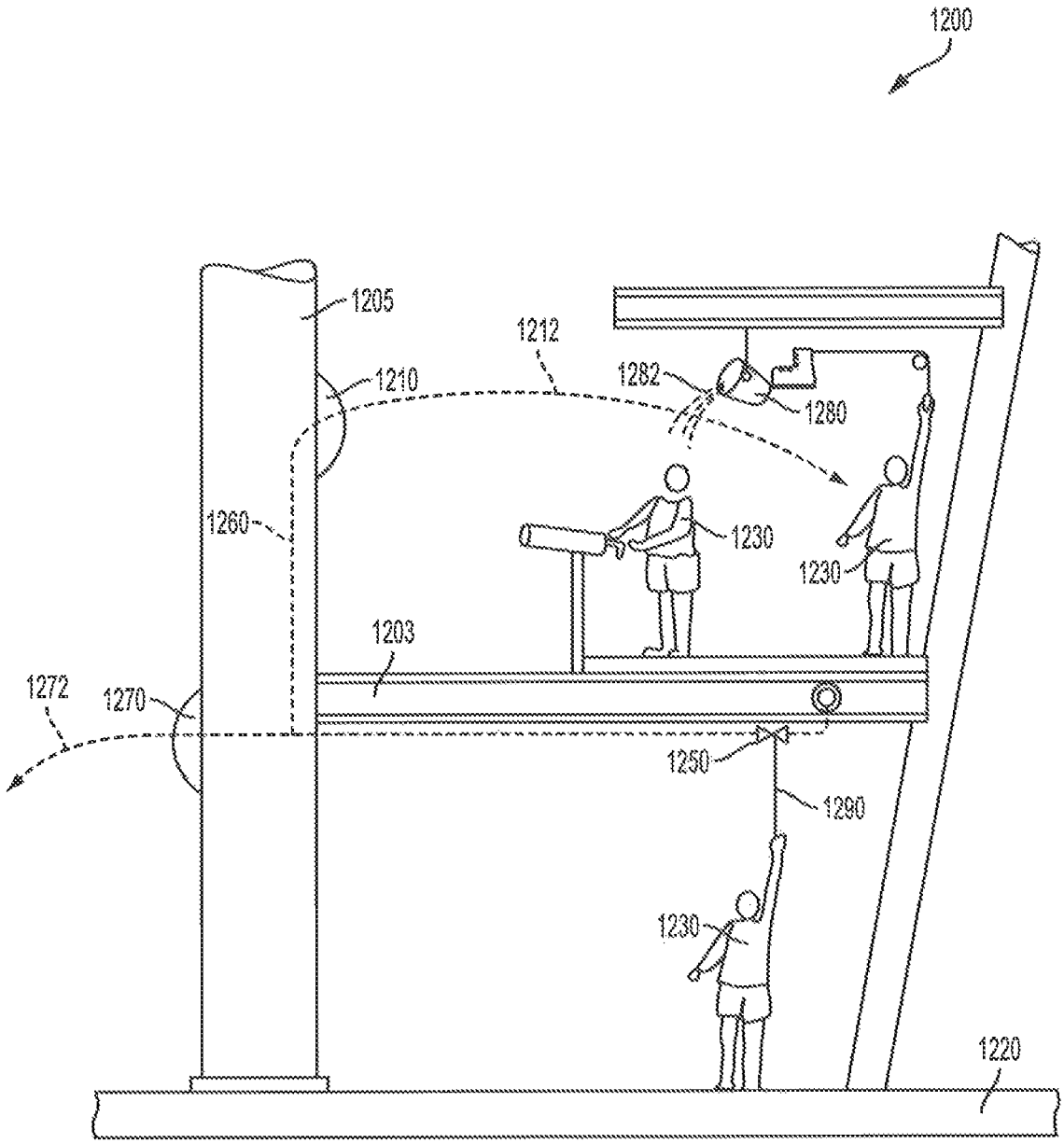
FIG. 12 shows an interactive structure according to an embodiment of the present invention.

FIG. 12 shows another example of an interactive structure 1200. Certain features or operation within an interactive play structure may be the same as or similar to those discussed throughout. The interactive structure 1200 includes a column component 1205 that may (or may not in alternative embodiments) be used for supporting a platform, deck, or other surface 1203 of an interactive play center, as previously discussed. A first consequence element 1210, a second consequence element 1270, and a third consequence element 1280 (e.g., one or more of them being in or on a hidden and/or themed element, such as an arch jet or nozzle or bucket) are capable of emitting a respective flow or provision (1212, 1272, 1282) of water or other fluid therefrom. A floor or ground surface 1220 is connected with the column component 1205 and provides a surface that one or more users 1230 may traverse thereon while simultaneously allowing for piping (not shown) and/or reservoir or fluid storage systems to be disposed thereunder and thus hidden from view and/or from being undesirably interfered with by the one or more users 1230.

A valve 1250 (for example, in one embodiment, a throttling valve) may be disposed within the column component 1205 and/or connected on or in the platform, deck, or other surface 1203 (or another location where the one or more users 1230 may not undesirably interfere therewith, such as beneath the floor or ground surface 1220). A hose or tube 1260 (for example, flexible or rigid, etc.) is connected with the valve 1250 for flowing of water or other fluid therethrough. Thus, as discussed throughout, the valve 1250 may be caused to open and/or close (e.g., via user interaction with some manipulatable element in a nearby or far-off area and/or merely continuously throttle a flow of fluid) to thereby cause water or other fluid to flow through the hose or tube 1260 when one or more users 1230 appropriately manipulate an interactive element 1290 (for example, in one embodiment, a lever, ripe, dial, button, etc.). Upon such manipulation of the interactive element 1290, fluid is permitted to flow through the valve 1250 and through to one or more of the consequence elements (1210, 1270, 1280). Alternative embodiments may utilize any of a variety of possible configurations or characteristics.

Figure 13:
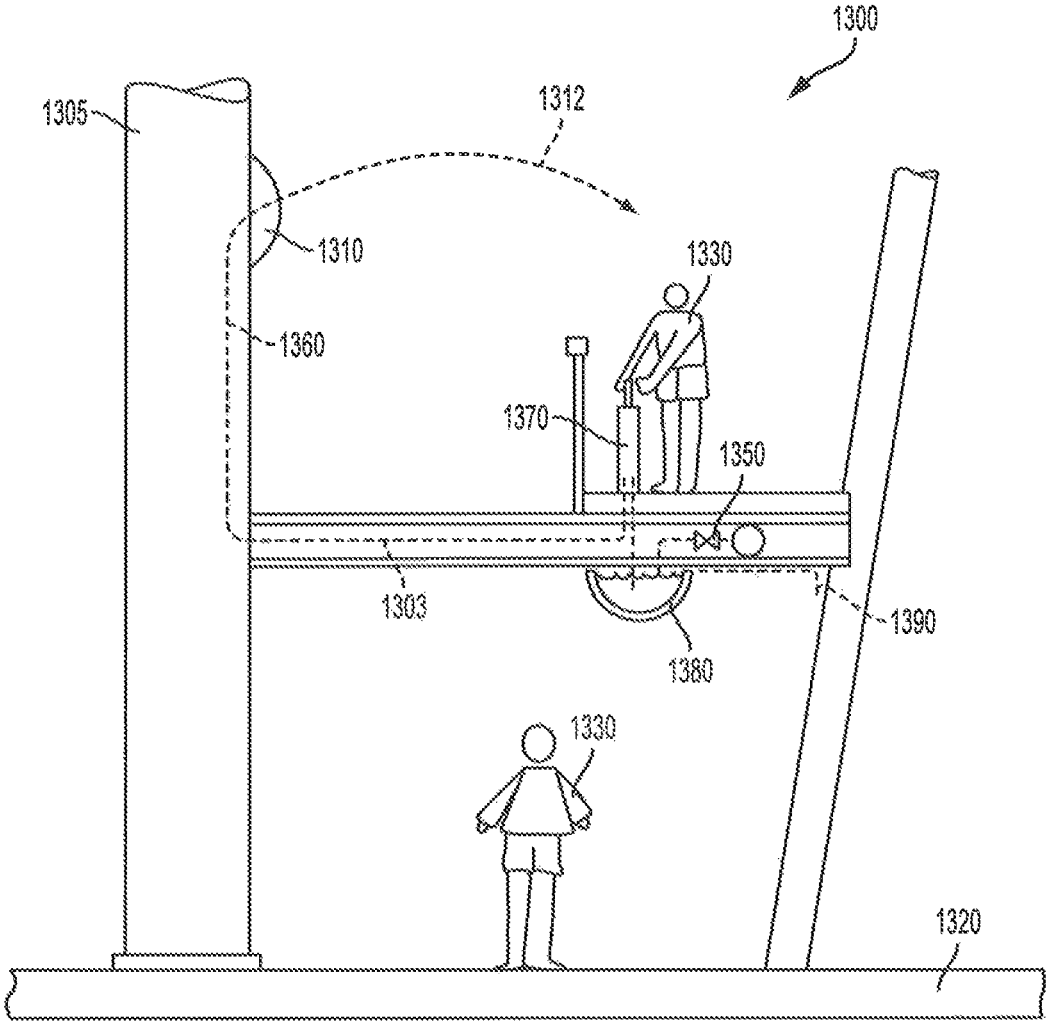
FIG. 13 shows an interactive structure according to an embodiment of the present invention.

FIG. 13 shows another example of an interactive structure 1300. Certain features or operation within an interactive play structure may be the same as or similar to those discussed throughout. The interactive structure 1300 includes a column component 1305 that may (or may not in alternative embodiments) be used for supporting a platform, deck, or other surface 1303 of an interactive play center, as previously discussed. A consequence element 1310 (e.g., a hidden and/or themed element, such as an arch jet or nozzle) is capable of emitting a flow 1312 of water or other fluid therefrom. A floor or ground surface 1320 is connected with the column component 1305 and provides a surface that one or more users 1330 may traverse thereon while simultaneously allowing for piping (not shown) and/or reservoir or fluid storage systems to be disposed thereunder and thus hidden from view and/or from being undesirably interfered with by the one or more users 1330.

A valve 1350 (for example, in one embodiment, a throttling valve) may be disposed within the column component 1305 and/or connected on or in the platform, deck, or other surface 1303 (or another location where the one or more users 1330 may not undesirably interfere therewith, such as beneath the floor or ground surface 1320). A hose or tube 1360 (for example, flexible or rigid, etc.) is connected with the consequence element 1310 and through a manipulatable element 1370 (for example, in one embodiment, a suction or bilge pump) such that one or more of the users 1330 may interface with the manipulatable element 1370 in order to pump fluid from a basin or reservoir 1380 and through the hose or tube 1360 to the consequence element 1310. The valve 1350 may be used to appropriately open or close a flow of water for refilling the basin or reservoir 1380 from a fluid source. An overflow pipe 1390 may be in fluid communication with the basin or reservoir 1380 for removal of fluid from the basin or reservoir 1380. Alternative embodiments may utilize any of a variety of possible configurations or characteristics.

Figure 14:
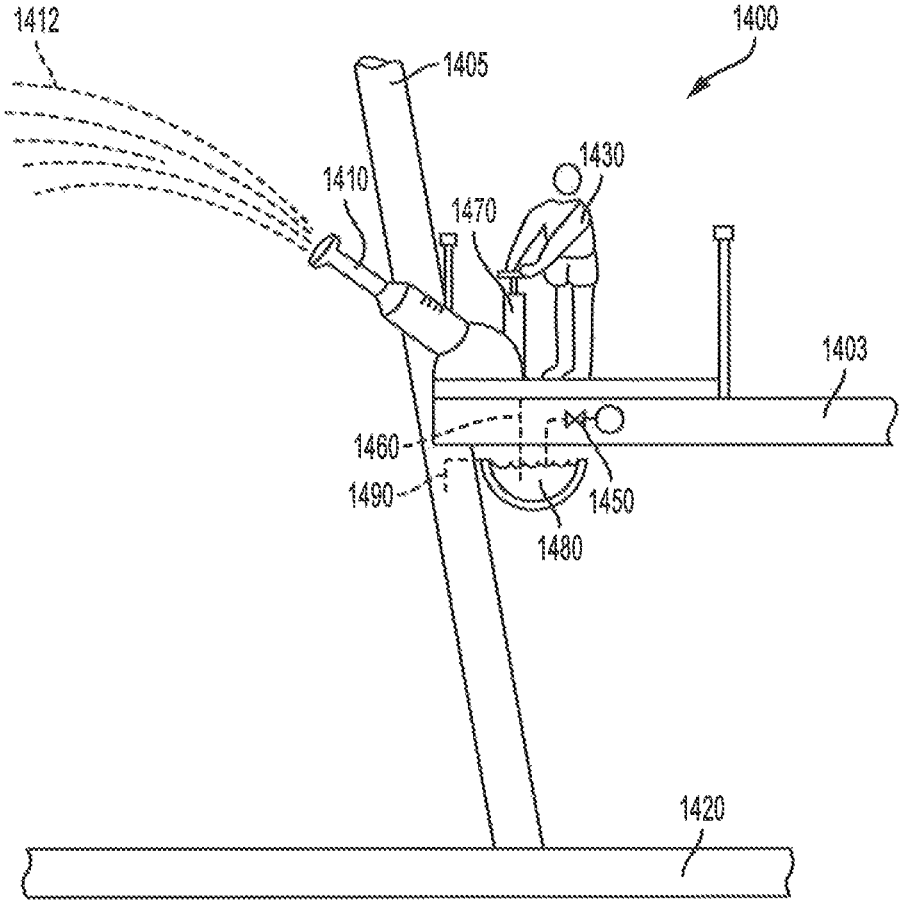
FIG. 14 shows an interactive structure according to an embodiment of the present invention.

FIG. 14 shows another example of an interactive structure 1400. Certain features or operation within an interactive play structure may be the same as or similar to those discussed throughout. The interactive structure 1400 includes a column component 1405 that may (or may not in alternative embodiments) be used for supporting a platform, deck, or other surface 1403 of an interactive play center, as previously discussed. A consequence element 1410 (e.g., a hidden and/or themed element, such as a water cannon with or without a fill gauge) is capable of emitting a flow 1412 of water or other fluid therefrom. A floor or ground surface 1420 is connected with the column component 1405 and provides a surface that one or more users 1430 may traverse thereon while simultaneously allowing for piping (not shown) and/or reservoir or fluid storage systems to be disposed thereunder and thus hidden from view and/or from being undesirably interfered with by the one or more users 1430.

A valve 1450 (for example, in one embodiment, a throttling valve) may be disposed within the column component 1405 and/or connected on or in the platform, deck, or other surface 1403 (or another location where the one or more users 1430 may not undesirably interfere therewith, such as beneath the floor or ground surface 1420). A hose or tube 1460 (for example, flexible or rigid, etc.) is connected with the consequence element 1410 and through a manipulatable element 1470 (for example, in one embodiment, a pressure pump) such that one or more of the users 1430 may interface with the manipulatable element 1470 in order to pump fluid from a basin or reservoir 1480 (for example, in one embodiment, a 3-gallon or other volume element hung from a bottom of the platform, deck, or other surface 1403) and through the hose or tube 1460 to the consequence element 1410. The valve 1450 may be used to appropriately open or close a flow of water for refilling the basin or reservoir 1480 from a fluid source. An overflow pipe 1490 may be in fluid communication with the basin or reservoir 1480 for removal of fluid from the basin or reservoir 1480. Alternative embodiments may utilize any of a variety of possible configurations or characteristics.

Figure 15:
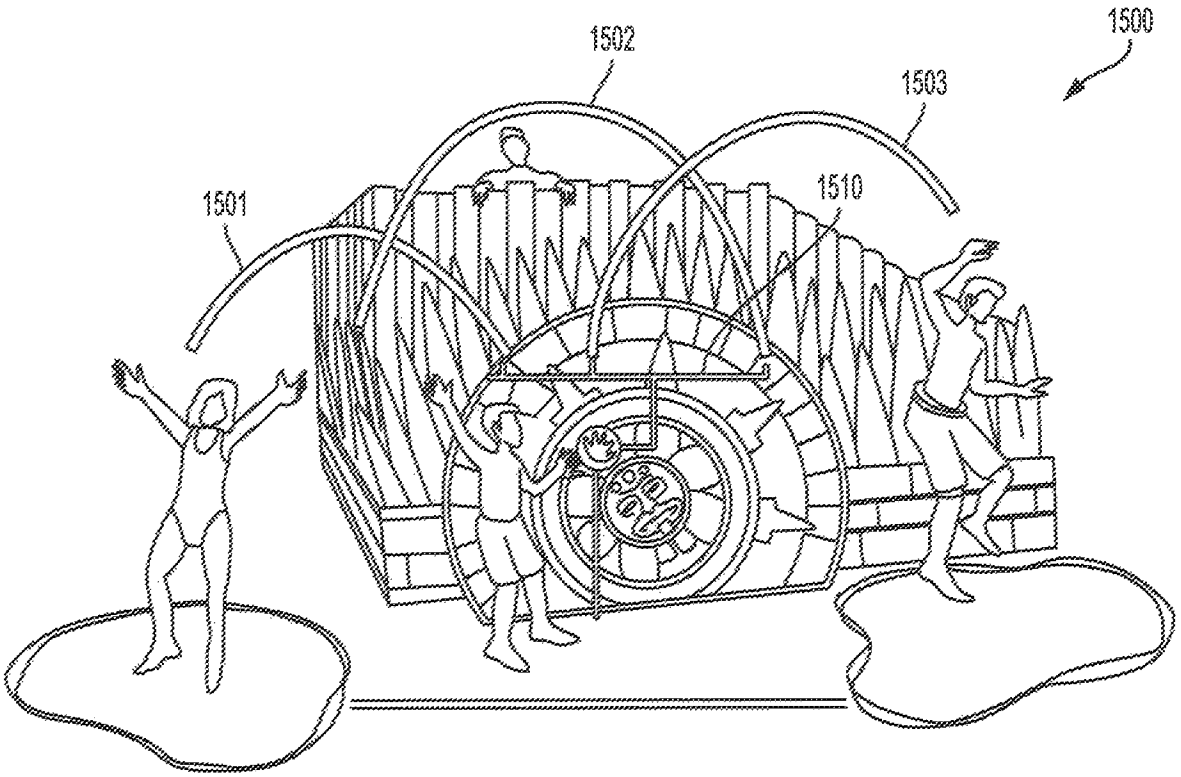
FIG. 15 shows an interactive structure according to an embodiment of the present invention.

FIGS. 15-18 illustrate various examples of potential consequence elements and/or interactive structures that may implement one or more features that are the same as or similar to those discussed throughout. Although specific elements and/or structures are shown having particular characteristics (for example, in certain embodiments, themes or other characteristics), alternative embodiments may utilize any of a variety of potential features and/or characteristics. For example, the embodiment of FIG. 15 illustrates a perspective view of an interactive structure 1500 that is configured to emit (1501, 1502, 1503) water or other fluids at a variety of locations in response to appropriate interaction with an activation button or element 1505. The interactive stricture 1500 is themed to appear like a dial (for example, in one embodiment, an "Aztec Dial") and has hidden piping 1510 disposed all or partially therein for the emitting (1501, 1502, 1503) of the water or other fluids (for example, via nozzles and/or arch jets hidden in the theming). Various features, operation, or use of the interactive structure 1500 within or as part of a larger interactive play center may be the same as or similar to those discussed throughout.

Figure 16A:
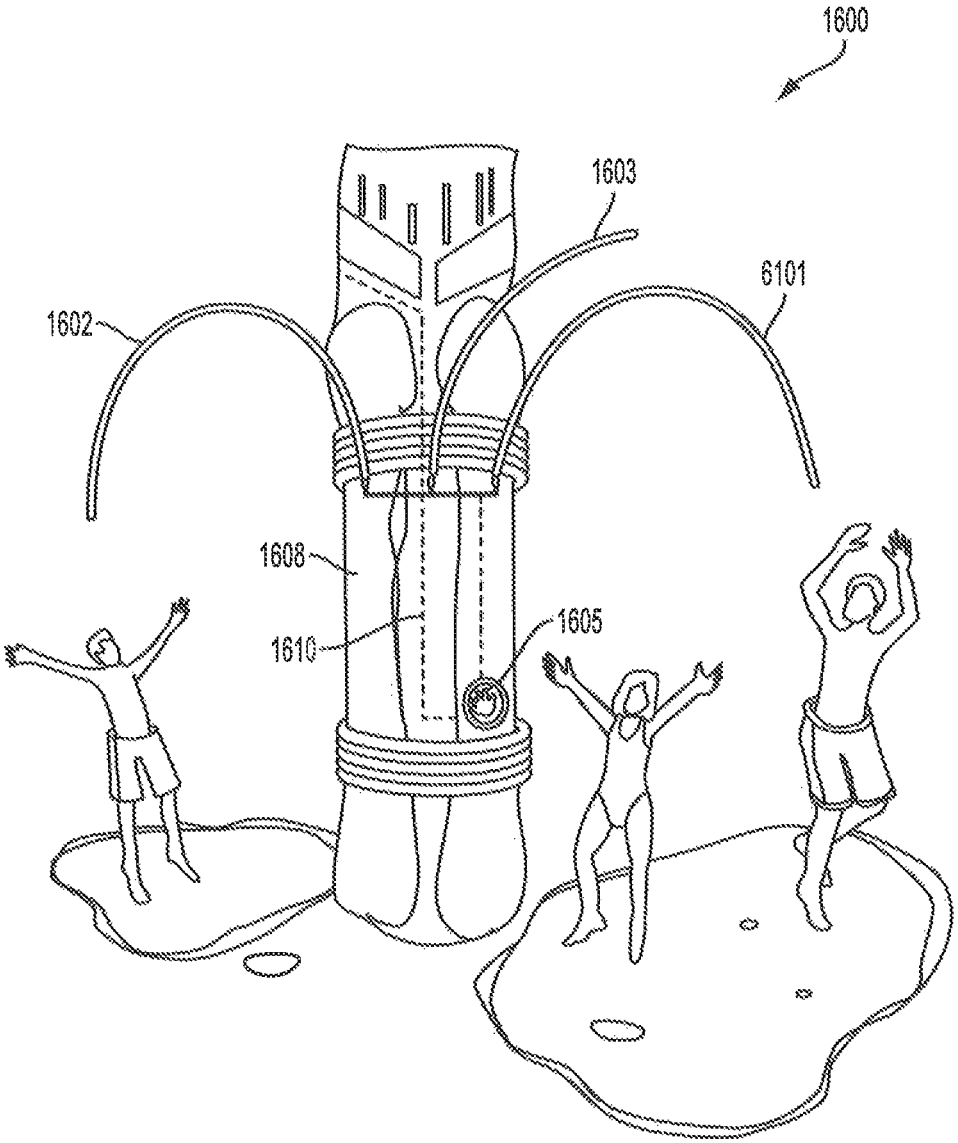
FIG. 16A shows an interactive structure according to an embodiment of the present invention.

Similarly, in another example, the embodiment of FIG. 16A illustrates a perspective view of an interactive structure 1600 that is configured to emit (1601, 1602, 1603) water or other fluids at a variety of locations in response to appropriate interaction with an activation button or element 1605. The interactive structure 1600 has a central column 1608 with hidden piping 1610 disposed all or partially therein for the emitting (1601, 1602, 1603) of the water or other fluids (for example, via nozzles and/or arch jets) above users and configured to rain down upon those users. Various features, operation, or use of the interactive structure 1600 within or as part of a larger interactive play center may be the same as or similar to those discussed throughout.

Figure 16B:
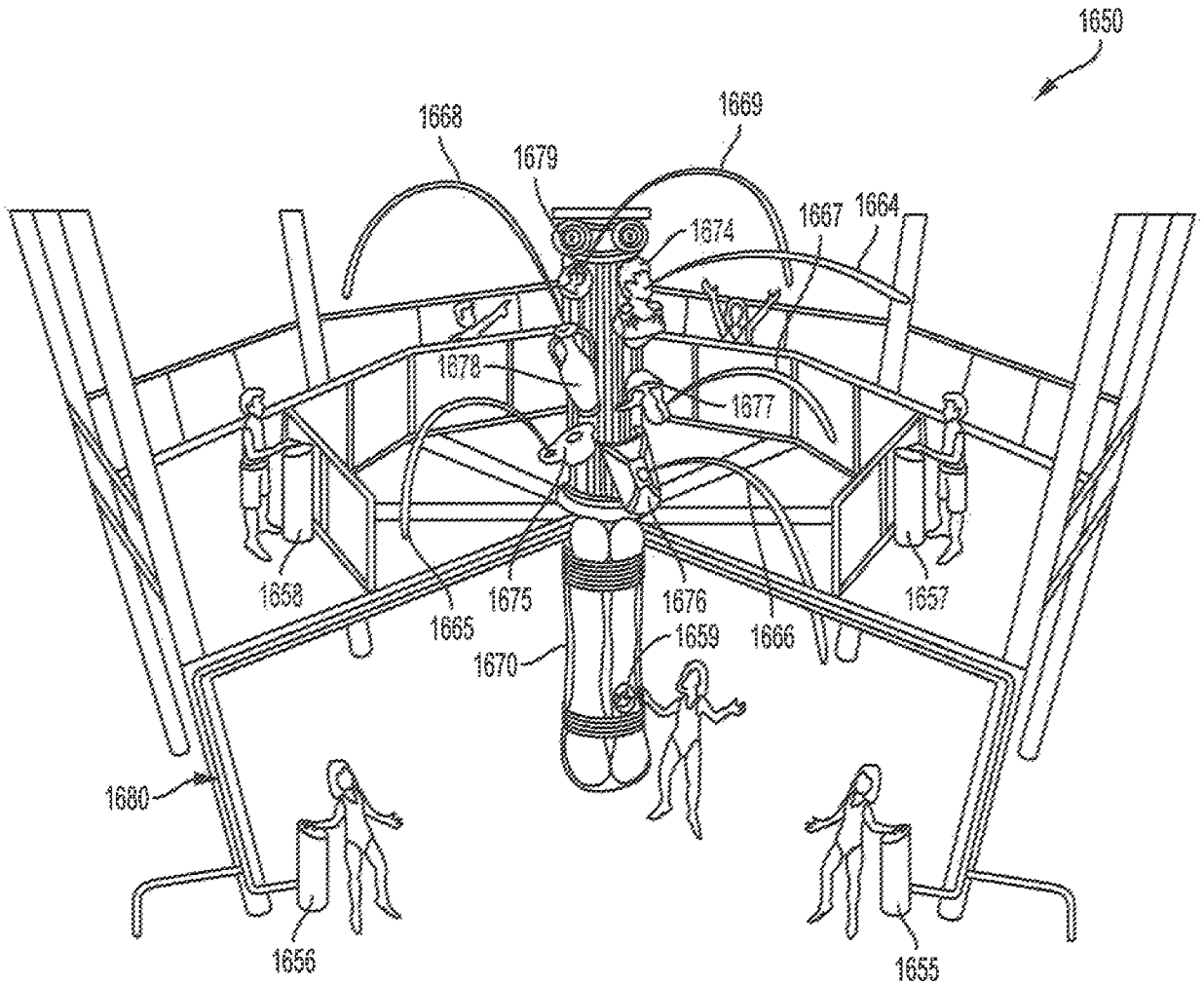
FIG. 16B shows the interactive structure of FIG. 16A within a larger interactive play center according to an embodiment of the present invention.

FIG. 16B illustrates a similar central column concept in the space of a larger interactive play center 1650. As discussed throughout, a column or pole 1670 may disposed at a location in the interactive play center 1650 (for example, in one embodiment, at a center of a play area). A plurality of interactive elements (1655, 1656, 1657, 1658, 1659), such as buttons, may be located within the play area and a plurality of consequence elements (1674, 1675, 1676, 1677, 1678, 1679) may be connected with the column or pole 1670 and configured to perform an action (1664, 1665, 1666, 1667, 1668, 1669), respectively, in response to interaction by a user with one or more of the plurality of interactive elements (1655, 1656, 1657, 1658, 1659) or automatically.

Figure 17:
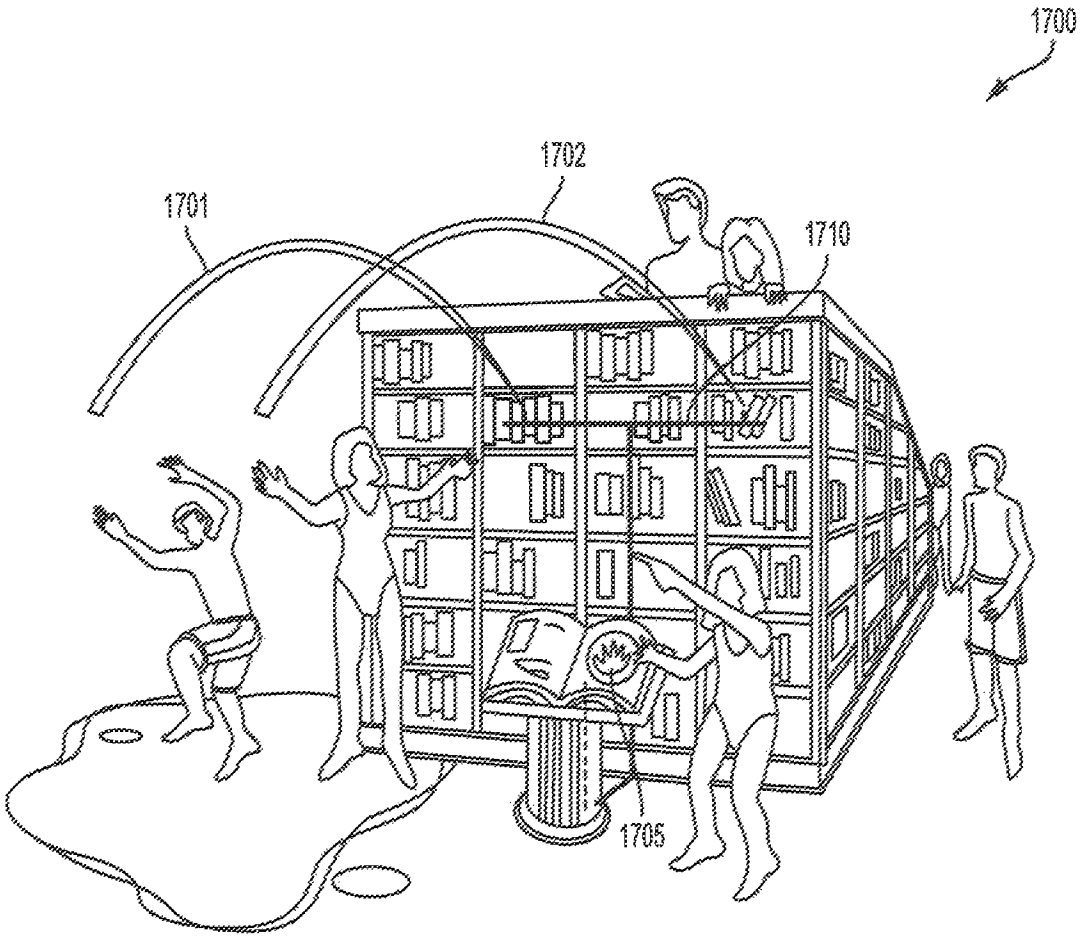
FIG. 17 shows an interactive structure according to an embodiment of the present invention.

In still another example, the embodiment of FIG. 17 illustrates a perspective view of an interactive structure 1700 that is configured to emit (1701, 1702) water or other fluids at a variety of locations in response to appropriate interaction with an activation button or element 1705. The interactive stricture 1700 is themed to appear like a bookcase or library and has hidden piping 1710 disposed all or partially therein for the emitting (1701, 1702) of the water or other fluids (for example, via nozzles and/or arch jets hidden in the theming). Various features, operation, or use of the interactive structure 1700 within or as part of a larger interactive play center may be the same as or similar to those discussed throughout.

Figure 18:
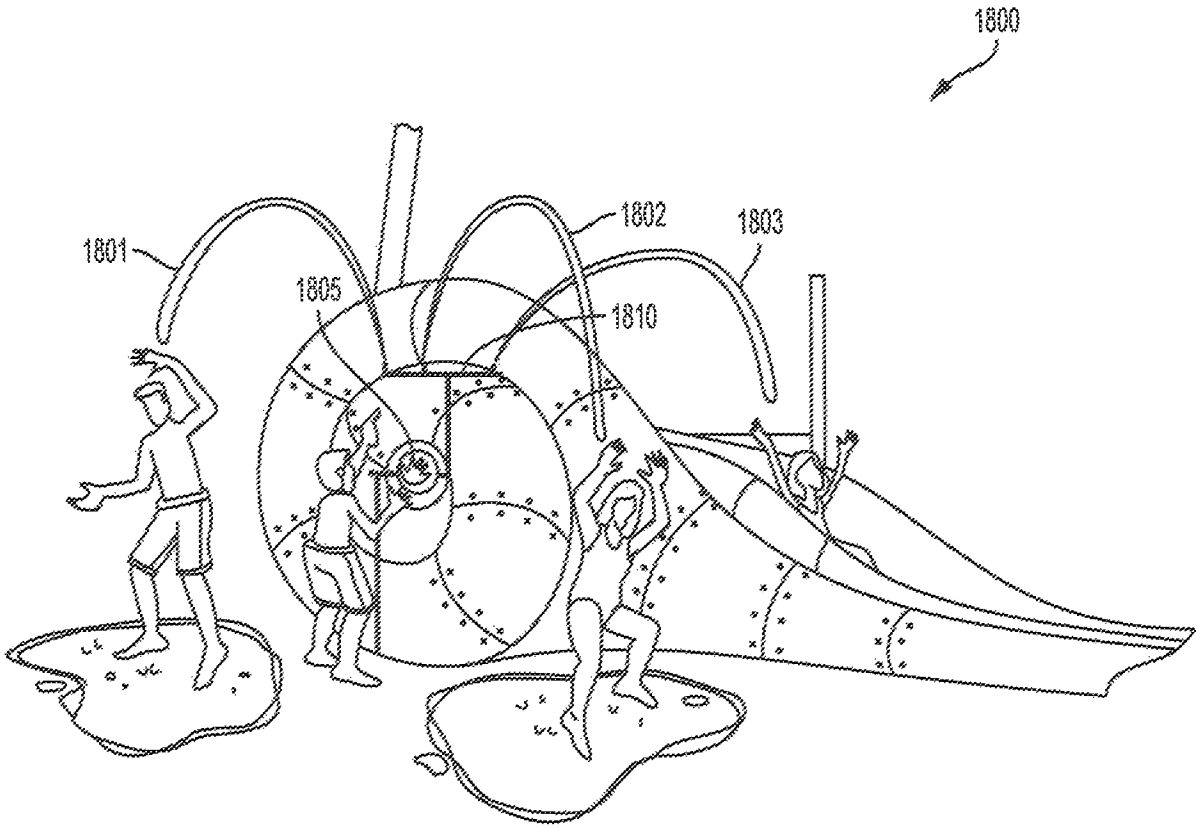
FIG. 18 shows an interactive structure according to an embodiment of the present invention.

In another example, the embodiment of FIG. 18 illustrates a perspective view of an interactive structure 1800 that is configured to emit (1801, 1802, 1803) water or other fluids at a variety of locations in response to appropriate interaction with an activation button or element 1805. The interactive stricture 1800 is themed to appear like a snail or nautilus and has hidden piping 1810 disposed all or partially therein for the emitting (1801, 1802, 1803) of the water or other fluids (for example, via nozzles and/or arch jets hidden in the theming). Various features, operation, or use of the interactive structure 1800 within or as part of a larger interactive play center may be the same as or similar to those discussed throughout.

Figure 19:
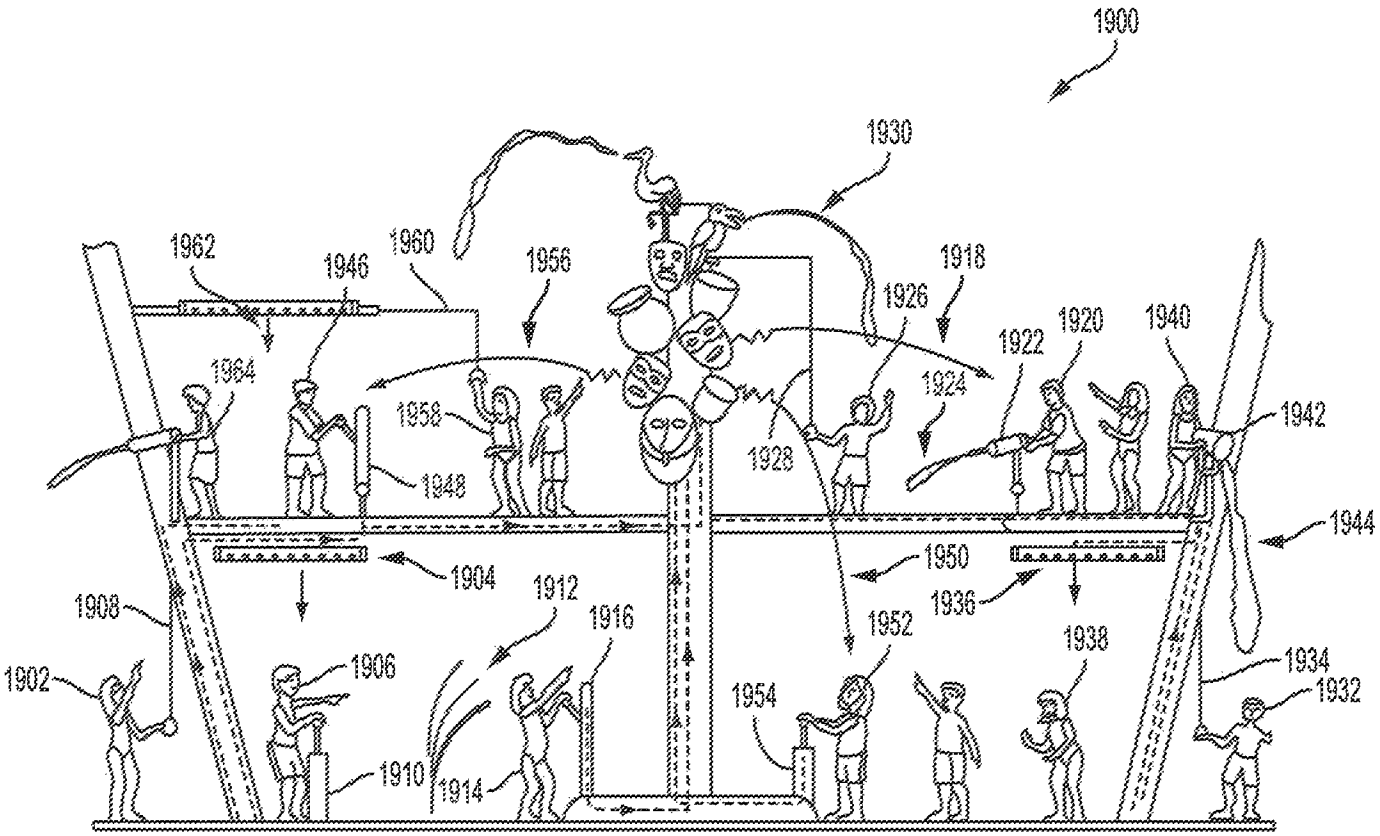
FIG. 19 shows a portion of an interactive play structure containing multiple interactive elements and multiple consequence elements according to an embodiment of the present invention.

FIG. 19 shows a side view of an interactive play center 1900 utilizing a plurality of interactive elements and resulting consequences. As illustrated, users in a first area of the interactive play center 1900 may cause activity or effects to occur in one or more different areas (e.g., a second area) of the interactive play center 1900, for example, by interfacing with one or more interactive elements located in the first area. For example and as shown, user 1902 may activate consequence 1904 (for example, in one embodiment, a dumping of water) upon user 1906 by interacting with interactive element 1908. However, the interactive element 1908 pulled by user 1902 and the consequence 1904 may not be located within the same or adjacent areas of the interactive play center 1900. In certain embodiments, consequence 1904 may occur on an opposite side or area of the interactive play center 1900 and/or may not be within viewing distance of user 1902.

In similar fashion and as shown, user 1906 may interact with interactive element 1910 (for example, in one embodiment, pulling on a lever) that activates consequence 1912 (for example, in one embodiment, spraying water) upon user 1914. User 1914 may interact with interactive element 1916 (for example, in one embodiment, pulling on a lever) that activates consequence 1918 (for example, in one embodiment, spraying water) upon user 1920. User 1920 may operate an interactive element 1922 (for example, in one embodiment, a water cannon) that directly has a consequence 1924 (for example, in one embodiment, spraying of water) on user 1926. User 1926 may interact with interactive element 1928 that activates consequence 1930 (for example, in one embodiment, dumping of water) onto user 1926.

Similarly, user 1932 may interact with interactive element 1934 (for example, in one embodiment, pulling on a rope) that activates consequence 1936 (for example, in one embodiment, spraying of water) onto user 1938. User 1940 may interact with interactive element 1942 (for example, in one embodiment, a bucket) to provide a consequence 1944 (for example, in one embodiment, a dumping of water) onto user 1932. User 1946 may interact with interactive element 1948 (for example, in one embodiment, pulling a lever) that activates consequence 1950 (for example, in one embodiment, a spray of water) upon user 1952. User 1952 may interact with interactive element 1954 (for example, in one embodiment, pushing a handle) that activates consequence 1956 (for example, in one embodiment, a spray of water) upon user 1946. User 1958 may interact with interactive element 1960 (for example, in one embodiment, pulling on a rope) that activates consequence 1962 (for example, in one embodiment, dumping water) upon user 1946. User 1964 may interact with interactive element 1966 (for example, in one embodiment, a water cannon) to directly spray water in one or more directions. Although specific actions and/or elements are specifically illustrated and/or described above for FIG. 19, such as particular elements or structures for user interaction and responses thereto, in alternative embodiments, any of a variety of possible elements may allow for user interaction or manipulation and any of a variety of possible actions or other consequences may result from such user interaction with those possible elements.

Thus, as shown, any of a variety of different interactive elements and/or activation mechanisms can cause a variety of consequences or effects, those effects not necessarily located nearby to the interactive element and/or activation mechanism that controls it. In this fashion, entertaining for users may be had due to the various sprays or consequences that occur our of various locations whereby the user may not initially be sure where the effect is going to take place or who is going to be impacted by the effect. In certain embodiments, the effect could come from above, below, beside, or in back and/or directed at the interactive element or activation mechanism itself. This may lead to a sense of fun, exploration, and/or uncertainty for users as they manipulate one of the interactive elements or activation mechanisms. FIG. 19 also illustrates a center monopole or column 1970 providing a number of consequences attached thereto with piping for those various consequences extending up an inside of the monopole 1970, the various piping then distributed among the effects that are connected with the monopole 1970. Alternative embodiments may differ in any of a variety of types of interactive elements and/or consequences and/or the locations thereof.

Figure 20:
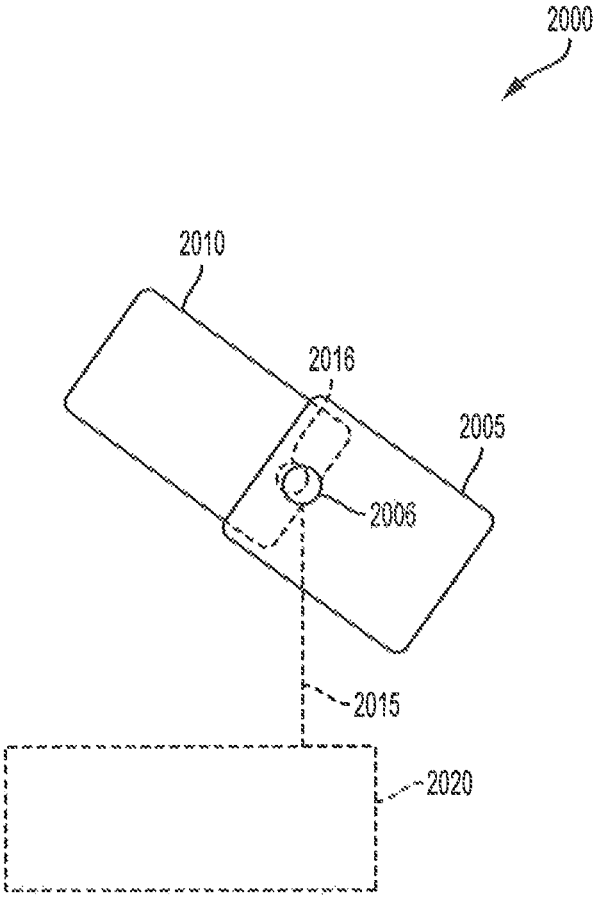
FIG. 20 shows a valve for use in an interactive play structure according to an embodiment of the present invention.

As previously discussed, control elements, such as valves for controlling fluid flow, may be built into interactive elements themselves, columns, poles, and/or floor elements. FIG. 20 illustrates one exemplary valve or control element 2000 that is built into the base and/or flooring for an interactive play center. For example, the interactive play center may contain an element (interactive, such as a button and/or non-interactive, such as a stream of water that flows therefrom) that is connected with a surface, such as a flooring surface. The valve 2000 may be constructed out of the fastening of a first plate or base 2005 with an overlapping second plate or base 2010. The first plate or base 2005 includes a hole or opening 2006 therein and the second plate or base 2010 also includes a hold or opening 2016 therein and both are at least partially in communication with piping 2015.

A reservoir or storage of fluid (for example, in one embodiment, water) 2020 may be disposed under a flooring surface of the interactive play center and configured to be pumped and/or otherwise flowed such that it sprays out of an element connected with the flooring surface via the piping 2015. By overlapping greater areas of the hole or opening 2006 with the hole or opening 2016, greater or fewer volumes of the fluid may be provided from the reservoir 2020, through the piping 2015, and eventually through the two holes or openings (2006, 2016). By manipulating this combined opening, the valve 2000 may act to regulate the amount, pressure, direction, shape, or other characteristic of the fluid that is permitted to flow therethrough from the piping 2015. In alternative embodiments, the first plate 2005 and/or the second plate 2010 may be configured to rotate (e.g., in response to electrical signals and/or via a user exerting a force thereon) in order to provide greater or lesser overlap of the holes or openings (2006, 2016) and thereby alter the amount of fluid that passes therethrough.

The embodiments and descriptions disclosed above can be configured to be used in conjunction with a play center that uses water or, in other embodiments, any other desired type of fluid (for example, in one embodiment, air, snow, bubbles, etc.). The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. An interactive play center comprising:
an interactive structure including:
a housing,
an interactive element coupled with the housing and configured to be interacted therewith, and
a turbine blade located within the housing; and
a consequence element in fluid communication with the interactive structure and configured to emit a fluid based upon the interactive element being interacted therewith,
wherein the interactive structure is configured so the fluid flows through the housing of the interactive structure before being emitted by the consequence element and the fluid causes the turbine blade to rotate for providing an indication that the interactive element has been interacted therewith.

2. The interactive play center of claim 1 wherein the first interactive element comprises a button configured to be pressed.

3. The interactive play center of claim 2 wherein the interactive structure is configured to cause the turbine blade to rotate by the fluid only when the button is being pressed.

4. The interactive play center of claim 1 wherein the fluid is water.

5. The interactive play center of claim 1 further comprising a valve in fluid communication with the consequence element, wherein the valve is configured to flow the fluid therethrough.

6. The interactive play center of claim 1 wherein the housing is at least partially transparent such that the turbine blade can be viewed through the housing.

7. The interactive play center of claim 1 further comprising a second interactive element, wherein the consequence element is configured to emit the fluid based upon simultaneous interaction with both of the interactive element and the second interactive element.

8. The interactive play center of claim 1 wherein the fluid is air.

9. An interactive play center comprising:
a housing;
an interactive element coupled with the housing and configured to be manipulated for causing a flow of fluid;
a turbine blade coupled with the housing and configured to rotate based on the flow of fluid for providing a visual stimulation that the interactive element has been manipulated;
a consequence element configured to emit the flow of fluid therefrom; and
at least one pipe segment coupled with the consequence element and configured to provide the flow of fluid to the consequence element from the turbine blade.

10. The interactive play center of claim 9 wherein the at least one pipe segment extends from the housing to the consequence element.

11. The interactive play center of claim 9 further comprising a valve located within the housing and configured to allow the flow of fluid to the turbine blade only when the interactive element is manipulated.

12. The interactive play center of claim 9 wherein the interactive element comprises a lever configured to be moved between at least two positions.

13. The interactive play center of claim 9 further comprising a reservoir disposed beneath the housing, the reservoir in fluid communication with the at least one pipe segment.

14. An interactive play center comprising:
a housing;
an interactive element configured to be interacted therewith for causing a fluid to flow;
a turbine blade coupled within the housing and configured to rotate based upon the fluid flow for providing a visual stimulation that the interactive element has been interacted therewith; and
a consequence element configured to activate based upon interaction with the interactive element and wherein the consequence element does not activate prior to the rotation of the turbine blade.

15. The interactive play center of claim 14 further comprising a second interactive element and wherein the consequence element is configured to activate based upon simultaneous interaction with both of the first interactive element and the second interactive element.

16. The interactive play center of claim 14 wherein the interactive element is coupled with the housing and is not positioned higher than 36 inches from a bottom of the housing.

17. The interactive play center of claim 14 wherein the interactive element is a button.

18. The interactive play center of claim 14 wherein the turbine blade is visible through at least a portion of the housing.

19. The interactive play center of claim 14 wherein the consequence element is configured to receive at least a portion of the fluid flow from the turbine blade and emit the at least the portion of the fluid flow therefrom.

20. The interactive play center of claim 14 wherein the consequence element comprises a nozzle.

* * * * *